United States Patent [19]

Mihayashi et al.

[11] Patent Number: 4,526,863

[45] Date of Patent: Jul. 2, 1985

[54] COLOR PHOTOGRAPHIC MATERIAL COMPRISING SILVER HALIDE LIGHT-SENSITIVE AND NON LIGHT-SENSITIVE LAYERS

[75] Inventors: Keiji Mihayashi; Shunji Takada; Hidetoshi Kobayashi, all of Kanagawa, Japan

[73] Assignee: Fuji Photo Film Co., Ltd., Kanagawa, Japan

[21] Appl. No.: 592,042

[22] Filed: Mar. 21, 1984

[30] Foreign Application Priority Data

Mar. 22, 1983 [JP] Japan ..... 58-47601

[51] Int. Cl.[3] ..... G03C 1/46; G03C 1/76; G03C 7/00

[52] U.S. Cl. ..... 430/505; 430/372; 430/506; 430/509; 430/543; 430/553; 430/555; 430/557; 430/558; 430/598; 430/955

[58] Field of Search ..... 430/553, 555, 557, 558, 430/593, 598, 955, 506, 509, 372

[56] References Cited

U.S. PATENT DOCUMENTS

| | | | |
|---|---|---|---|
| 2,126,337 | 8/1938 | Mannes et al. | 430/558 X |
| 3,883,369 | 9/1974 | Chiklis et al. | 430/517 X |
| 3,960,558 | 6/1976 | Cardone | 430/506 X |
| 4,086,094 | 4/1978 | Shiba et al. | 430/555 X |
| 4,115,121 | 9/1978 | Evans et al. | 430/557 X |
| 4,186,016 | 1/1980 | Lohmann et al. | 430/506 |
| 4,273,861 | 6/1981 | Shiba et al. | 430/557 X |
| 4,390,618 | 6/1983 | Kobayashi et al. | 430/557 X |
| 4,434,225 | 2/1984 | Sugita et al. | 430/558 X |

*Primary Examiner*—John E. Kittle
*Assistant Examiner*—Mukund J. Shah
*Attorney, Agent, or Firm*—Sughrue, Mion, Zinn, Macpeak, and Seas

[57] ABSTRACT

A silver halide photographic light-sensitive material comprising a support having thereon at least two light-sensitive silver halide emulsion layers which are sensitive to light of substantially the same spectral region and a relatively light-insensitive layer containing silver halide, zinc oxide or titanium oxide positioned between the two light-sensitive silver halide emulsion layers and at least one of the two light-sensitive silver halide emulsion layers containing a compound represented by the following general formula (I):

A—B (I)

wherein A represents a residue of a compound capable of coupling with the oxidation product of an aromatic primary amine developing agent by removal of a hydrogen atom from the active position of the compound, and B represents a group which is released on coupling and exhibits a fogging function in a developing solution. The silver halide photographic light-sensitive material containing the compound represented by the general formula (I) has improved granularity as well as has high sensitivity.

32 Claims, No Drawings

COLOR PHOTOGRAPHIC MATERIAL COMPRISING SILVER HALIDE LIGHT-SENSITIVE AND NON LIGHT-SENSITIVE LAYERS

FIELD OF THE INVENTION

The present invention relates to a silver halide color photographic light-sensitive material containing a compound capable of releasing a fogging agent or a development accelerator in an imagewise manner in which the sensitivity and gradation are increased and development is accelerated. More particularly, the present invention relates to a silver halide color photographic light-sensitive material in which the granularity is improved even though the material has high sensitivity.

BACKGROUND OF THE INVENTION

Recently, it has been desired to highly increase the sensitivity of silver halide photographic light-sensitive materials, in particular, used for photography, as typically shown by ISO 400 films, etc. In order to increase the sensitivity, investigations have been made on a variety of techniques, including, e.g., use of large size silver halide grains, couplers with higher activities, accelerated development, etc. However, the limit appears to have been reached in increasing the sensitivity based on use of large size silver halide grains, as reported by G. C. Farnell and J. B. Chanter in *Journal of Photographic Science,* Vol. 9, page 75 (1961). Accordingly, this technique is not expected to make much of a contribution in the future. In addition, the use of large size silver halide grains has various disadvantages, such as a deterioration in granularity, increase in thickness of the emulsion layer, and deterioration in storability. Further, increasing sensitivity by using couplers with higher activities or accelerated development is disadvantgeous since these techniques not only are accompanied by a marked deterioration in granularity but also do not give rise to much of a contribution in sensitivity. With regard to acceleration of development, various development accelerators, including hydrazine compounds, have hitherto been incorporated into a silver halide emulsion layer or a developing solution therefor mainly for black-and-white photographic light-sensitive materials. However, in most cases, the incorporation of development accelerators into an emulsion layer or a developing solution is accompanied by disadvantages such as an increase in fog and a deterioration in granularity, and hence are impractical.

Further, couplers which release development accelerators or fogging agents in an imagewise manner have also been proposed. For example, couplers releasing thiocyanic acid ions which accelerate solution physical development are disclosed in U.S. Pat. Nos. 3,214,377 and 3,253,924, Japanese Patent Application (OPI) No. 17437/76 (the term "OPI" as used herein refers to a "published unexamined Japanese patent application"), etc.; also, couplers releasing hydroquinone or aminophenol developing agents are described in Japanese Patent Application (OPI) No. 138636/82. However, the development accelerating function or the fogging function of these releasable groups is small and thus the effects obtained are very small even if couplers releasing these groups are used in a large amount. In order to overcome these problems, couplers releasing acyl hydrazines as described in U.S. Pat. No. 4,390,618 and couplers releasing thiocarbonyl compounds as described in Japanese Patent Application No. 161515/82 (corresponding to U.S. patent application Ser. No. 532,631 filed on Sept. 15, 1983 and West German Patent Application P No. 33 33 355.6 filed on Sept. 15, 1983) have been proposed and thus high sensitivity has been achieved with these couplers.

It has been found, however, that these couplers have the disadvantage in that color mixing occurs and the color reproducibility is degraded since the releasable groups diffuse into other layers which are sensitive to light in a different region in the spectrum to cause develpment acceleration or to form fog due to their high diffusibility, when they are incorporated into a certain light-sensitive layer which is sensitive to light of a specific region of the spectrum. It has also been found that these couplers have the disadvantage in that the granularity is deteriorated in comparison with cases wherein these couplers are not used to increase the sensitivity since the releasable groups freely diffuse in the layer to be added or into a layer which is sensitive to light of the same region in the spectrum causing development acceleration or forming fog even when they do not diffuse into the layers sensitive to light of a different region.

On the other hand, other techniques for increasing sensitivity based on the investigation on layer structure of photographic light-sensitive materials have been proposed. For example, a method to obtain high sensitivity in an emulsion layer by providing a layer containing fine reflective particles beneath the emulsion layer to utilize the light scattering function due to these fine particles as described in *Research Disclosure,* Vol. 134, page 47, No. 13452 (1975). This method is in fact effective to increase the sensitivity. However, the increase in sensitivity in this method is at most twice due to only the light scattering effect and the method is accompanied by difficulty in practical use in that the granularity is markedly deteriorated as the sensitivity is increased.

SUMMARY OF THE INVENTION

Therefore, an object of the present invention is to provide a silver halide photographic light-sensitive material having high sensitivity and improved granularity.

Another object of the present invention is to provide a silver halide photographic light-sensitive material having good color reproducibility.

Other objects of the present invention will become apparent from the following detailed description and examples.

These objects of the present invention are achieved by a silver halide photographic light-sensitive material comprising a support having thereon at least two light-sensitive silver halide emulsion layers which are sensitive to light of substantially the same region of the spectrum and a relatively light-insensitive layer containing silver halide, zinc oxide or titanium oxide positioned between the two light-sensitive silver halide emulsion layers and at least one of the two light-sensitive silver halide emulsion layers containing a compound represented by the following general formula (I):

$$A—B \quad (I)$$

wherein A represents a residue of a compound capable of coupling with the oxidation product of an aromatic primary amine developing agent by the removal of a hydrogen atom from the active position of the compound, and B represents a group which is released on coupling and exhibits a fogging function in a developing solution.

DETAILED DESCRIPTION OF THE INVENTION

As previously stated, when the compound represented by the general formula (I) is incorporated into a silver halide emulsion layer, the granularity is deteriorated in comparison with a case wherein the compound is not incorporated, color mixing occurs and color reproducibility is degraded although the sensitivity increases. In order to prevent a deterioration of granularity, it is very effective to add a relatively light-insensitive emulsion to a layer containing the compound represented by the general formula (I). However, this method results in repression of the increase in sensitivity in most cases although a small increase in sensitivity is observed. Further, it is very effective to provide a relatively light-insensitive emulsion layer between emulsion layers which are sensitive to light of a different region from each other of the spectrum for improving color reproducibility, but a marked increase in sensitivity is not observed in most cases as achieved by the present invention. It is surprisingly found that not only is the sensitivity increased but also the granularity is improved according to the present invention. These effects are specifically shown in the examples hereinafter.

The compound represented by the general formula (I) which can be used in the present invention is described in detail below.

In the general formula (I), the coupler residue represented by A specifically is a residue derived from a cyan coupler, a magenta coupler, a yellow coupler or a non-color-forming coupler. The group which exhibits a fogging function represented by B specifically is a group containing a partial structure of a reducing compound, for example, a hydrazine, a hydrazide, a hydrazone, an enamine, a polyamine, a hydroquinone, an aminophenol, a phenylenediamine, an acetylene, an aldehyde, etc., or a compound capable of forming silver sulfide, for example, a thiocarbonyl compound as typically illustrated by a thiourea, a thiocarbamate, a dithiocarbamate, a rhodanine, a thiohydantoin, etc.

Of the compounds represented by the general formula (I), compounds preferably employed are represented by the following general formula (II):

$$A—(TIME)_n—FA \quad (II)$$

wherein A has the same meaning as defined for A in the general formula (I); TIME represents a timing group which is released upon coupling and subsequently releases FA in a developing solution; n represents 0 or 1; and FA represents a group which is capable of being released from A upon coupling when n is 0 or is capable of being released from TIME when n is 1 and has the ability to be adsorbed on silver halide particles and substantially provide a fogging function on silver halide.

A group having the ability to substantially provide a fogging function on silver halide is a group (compound) which forms measurable fog when a photographic light-sensitive material is subjected to development processing in the presence of the compound.

Examples of FA include groups represented by the formula $[AD—(L)_m—X—$ and a group having the functions of or structures of both AD and X therein. In the above formula, AD represents a group capable of being adsorbed on silver halide particles; L represents a divalent linking group; X represents a reducing group or a group capable of forming silver sulfide at development; and m represents 0 or 1.

When FA is a group represented by the formula $[AD—(L)_m—X—$, the group can be bonded to TIME (or A) at an appropriate position thereof. Naturally a group which has simultaneously the functions of both AD and X is also preferred.

Examples of coupler residues represented by A include residues of cyan couplers, such as phenol couplers and naphthol couplers, etc.; residues of magenta couplers, such as 5-pyrazolone couplers, pyrazolobenzimidazole couplers, pyrazolotriazole couplers, cyanoacetylcoumarone couplers, open chain acylacetonitrile couplers and indazolone couplers, etc.; residues of yellow couplers, such as benzoylacetanilide couplers, pivaloylacetanilide couplers, and malondianilide couplers, etc.; and residues of non-color-forming couplers, such as open chain or cyclic active methylene compounds (e.g., indanones, cyclopentanones, diesters of malonic acid, imidazolinones, oxazolinones, thiazolinones, etc.), etc.

Those coupler residues represented by A which are preferably used in the present invention include the residues represented by the following general formula (III), (IV), (V), (VI), (VII), (VIII), (IX), (X) or (XI):

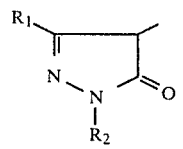

(III)

wherein $R_1$ represents an acylamido group, an anilino group or a ureido group; and $R_2$ represents a phenyl group which may be substituted with one or more substituents selected from a halogen atom, an alkyl group, an alkoxy group or a cyano group;

(IV)

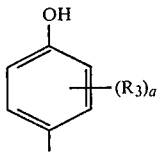

(V)

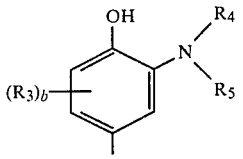

(VI)

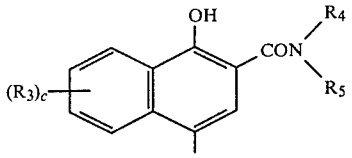

wherein $R_3$ represents a halogen atom, an acylamido group or an aliphatic group; $R_4$ and $R_5$ each represents an aliphatic group, an aromatic group or a heterocyclic group, and one of $R_4$ and $R_5$ may represent a hydrogen atom; a represents an integer of 1 to 4; b represents 0 or an integer of 1 to 3; and c represents 0 or an integer of 1 to 5;

(VII)

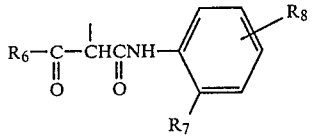

(VIII)

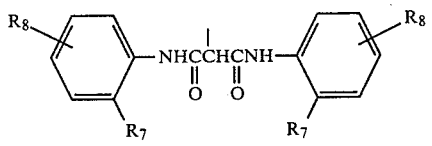

wherein $R_6$ represents a tertiary alkyl group or an aromatic group; $R_7$ represents a hydrogen atom, a halogen atom or an alkoxy group; and $R_8$ represents an acylamido group, an aliphatic group, an alkoxycarbonyl group, a sulfamoyl group, a carbamoyl group, an alkoxy group, a halogen atom or a sulfonamido group;

(IX)

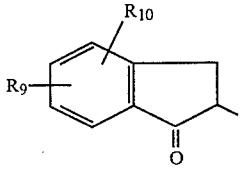

wherein $R_9$ represents an aliphatic group, an alkoxy group, a mercapto group, an alkylthio group, an acylamido group, an alkoxycarbonyl group, a sulfonamido group, a carbamoyl group, a sulfamoyl group, an alkoxysulfonyl group, an aryloxysulfonyl group, an acyl group, a diacylamino group, an alkylsulfonyl group or an arylsulfonyl group; and $R_{10}$ represents a hydrogen atom, a halogen atom, an alkoxy group, an acyl group, a nitro group, an alkylsulfonyl group or an arylsulfonyl group; or the indanone group represented by the general formula (IX) above may be used in the form of an enol ester thereof;

(X)

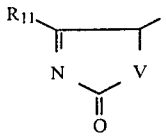

wherein $R_{11}$ represents an aliphatic group or an aromatic group; and V represents an oxygen atom, a sulfur atom or a nitrogen atom;

(XI)

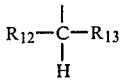

wherein $R_{12}$ and $R_{13}$ each represents a group selected from groups of the formula

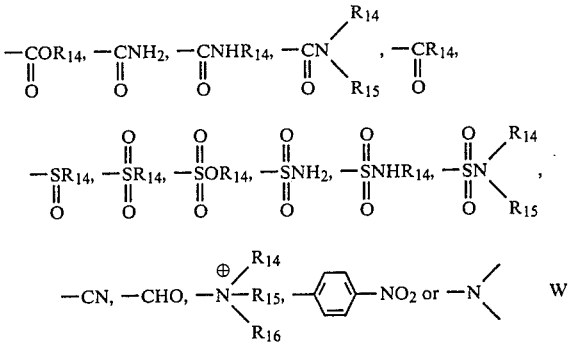

wherein $R_{14}$, $R_{15}$ and $R_{16}$ each represents a hydrogen atom, an aliphatic group, an aromatic group or a heterocyclic group; and W represents the non-metallic atoms necessary to form a 5-membered or 6-membered ring together with the nitrogen atom; or $R_{12}$ and $R_{13}$ in combination may form a 5-membered or 6-membered ring together with non-metallic atoms as necessary.

The timing group represented by TIME in the general formula (II) includes a group which is released from A upon coupling and subsequently releases FA due to an intramolecular displacement reaction as described in U.S. Pat. No. 4,248,962, Japanese Patent Application (OPI) No. 56837/82, etc., a group which releases FA upon electron transfer via a conjugated system as described in British Patent No. 2,072,363A, Japanese Patent Application (OPI) Nos. 154234/82 and 188035/82, etc., or a coupling component group capable of releasing FA upon coupling with the oxidation product of an aromatic primary amine developing agent as described in Japanese Patent Application (OPI) No. 111536/82, etc. These reactions may occur in one stage or multi stages.

When FA is a group represented by the formula $[AD—(L)_m—X—$, AD can be directly bonded to the carbon atoms at the coupling position, or L or X may be bonded to the carbon atom at the coupling position so long as L or X can be released upon coupling. Further, the so-called 2-equivalent releasable group may be present between the carbon atom at the coupling position and AD. Examples of such 2-equivalent releasable groups include an alkoxy group (for example, a methoxy group, etc.), an aryloxy group (for example, a phenoxy group, etc.), an alkylthio group (for example, an ethylthio group, etc.), an arylthio group (for example, a phenylthio group, etc.), a heterocyclicoxy group (for example, a tetrazolyloxy group, etc.), a heterocyclicthio group (for example, a pyridylthio group, etc.), a heterocyclic group (for example, a hydantoinyl group, a pyrazolyl group, a triazolyl group, a benzotriazolyl group, etc.), etc. Moreover, the groups described in British Patent Application (OPI) No. 2,011,391 A may be used as FA.

Examples of groups represented by AD capable of being adsorbed on silver halide include a group derived from a nitrogen-containing heterocyclic ring having a dissociable hydrogen atom (for example, pyrrole, imidazole, pyrazole, triazole, tetrazole, benzimidazole, benzopyrazole, benzotriazole, uracil, tetraazaindene, imidazotetrazole, pyrazolotriazole, pentaazaindene, etc.), a heterocyclic ring containing at least one nitrogen atom and at least one other hetero atom (for example, an oxygen atom, a sulfur atom, a selenium atom, etc.) in its ring (for example, oxazole, thiazole, thiazoline, thiazolidine, thiadiazole, benzothiazole, benzoxazole, etc.), a heterocyclic ring having a mercapto group (for example, 2-mercaptobenzothiazole, 2-mercaptopyrimidine, 2-mercaptobenzoxazole, 1-phenyl-5-mercaptotetrazole, etc.), a quaternary salt (for example, a quaternary salt of a tertiary amine, pyridine, quinoline, benzothiazole, benzimidazole, benzoxazole, etc.), a thiophenol, an alkylthiol (for example, cysteine, etc.), a compound having a partial structure of

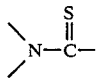

(for example, a thiourea, a dithiocarbamate, a thioamide, a rhodanine, a thiazolidinethione, a thiohydantoin, a thiobarbituric acid, etc.), etc.

The divalent linking group represented by L in FA can be a group selected from conventionally used divalent groups including, for example, an alkylene group, an alkenylene group, a phenylene group, a naphthylene group, —O—, —S—, —SO—, —$SO_2$—, —N=N—, a carbonyl group, an amido group, a thioamido group, a sulfonamido group, a ureido group, a thioureido group, a heterocyclic group, etc.

Examples of groups represented by X include a group derived from a reducing compound (for example, a hydrazine, a hydrazide, a hydrazone, a hydroquinone, a catechol, a p-aminophenol, a p-phenylenediamine, a 1-phenyl-3-pyrazolidinone, an enamine, an aldehyde, a polyamine, an acetylene, an aminoborane, a quaternary salt such as a tetrazolium salt, an ethylenebispyridinium salt, etc., a carbazinic acid, etc.) or a compound capable of forming silver sulfide at development (for example, a compound having a partial structure of

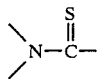

such as a thiourea, a thioamide, a dithiocarbamate, a rhodanine, a thiohydantoin, a thiazolidinethione, etc.), etc. Among the groups capable of forming silver sulfide at development represented by X, certain groups are capable of being adsorbed on the silver halide particles themselves and thus they can also act as the adsorbing group represented by AD.

FA can be bonded to TIME or A at the adsorbing site for silver halide particles (for example, a nitrogen atom of benzotriazole, a sulfur atom of 1-phenyl-5-mercaptotetrazole, etc.) but FA is not limited thereto. In the latter case it is preferred for a hydrogen atom to be bonded to the adsorbing site or that the absorbing site be blocked with a hydrolyzable group in a developing solution (for example, an acetyl group, a benzoyl group, a methanesulfonyl group, etc.) or a releasable group in a developing solution (for example, a 2-cyanoethyl group, a 2-methanesulfonylethyl group, etc.).

Specific examples of AD which can be used are set forth below.

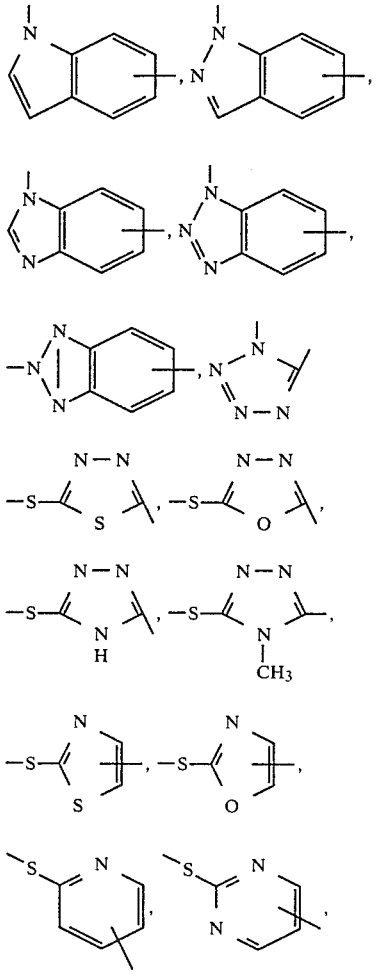

-continued
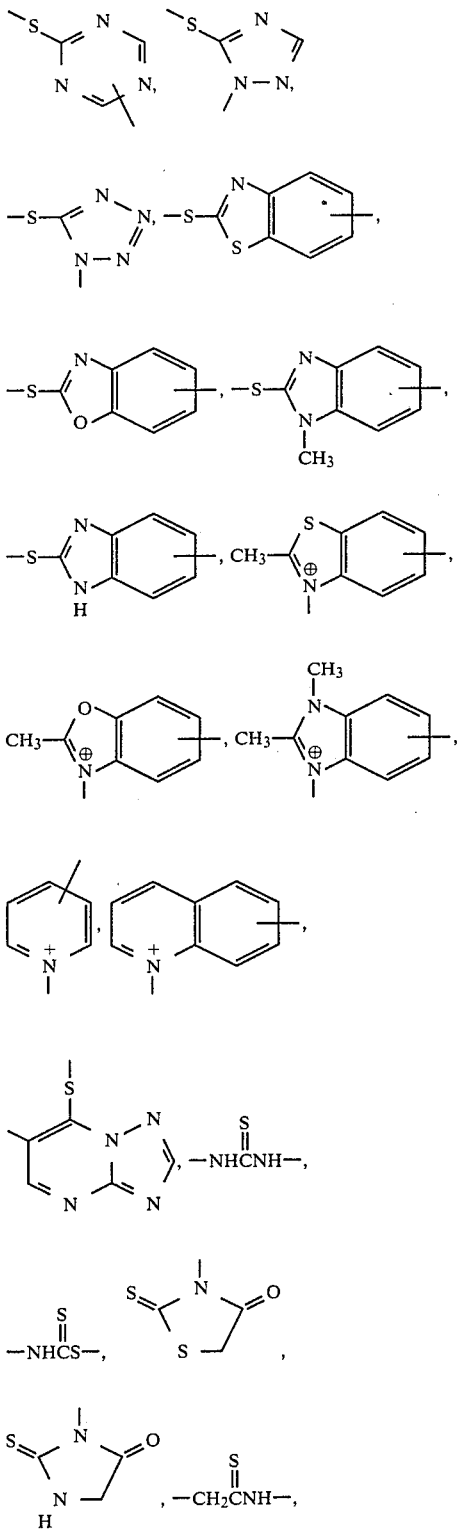
Specific examples of L which can be used are set forth below.
$-CH_2-$, $-CH_2CH_2-$, $-OCH_2-$, $-OCH_2CH_2-$, $-SCH_2-$,
-continued
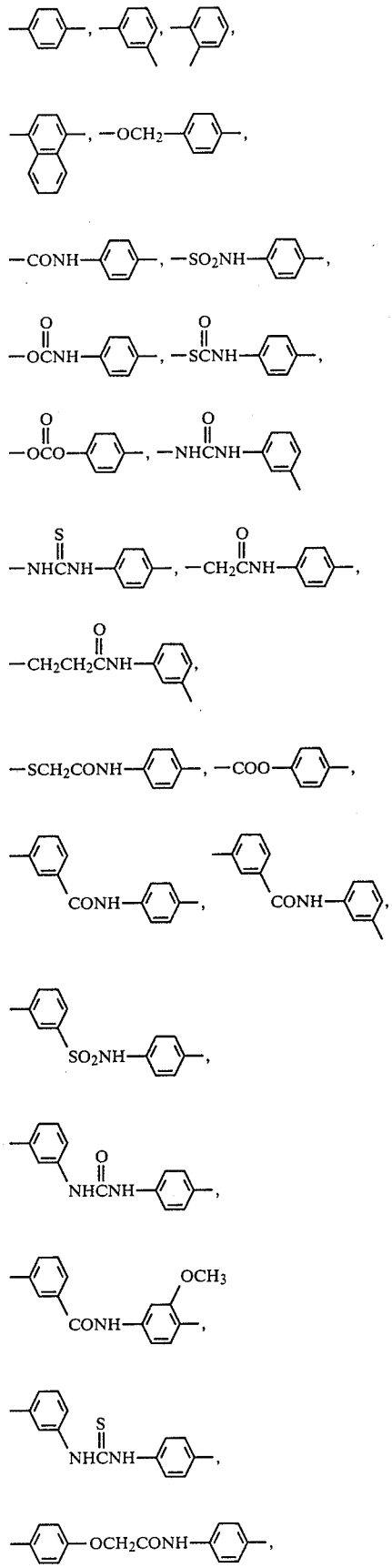

-continued
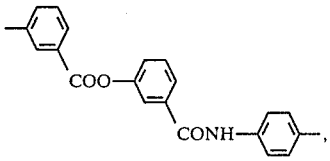
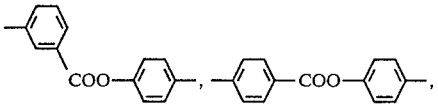
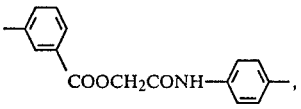
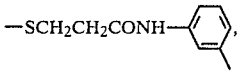
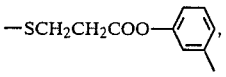
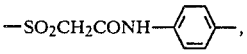
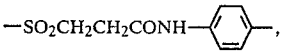
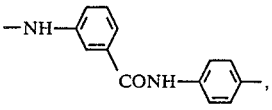
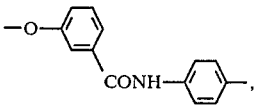
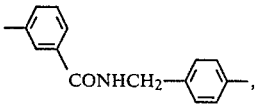
Specific examples of X which can be used are set forth below.
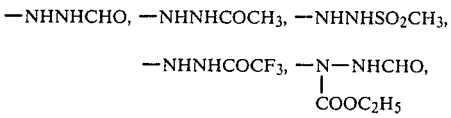
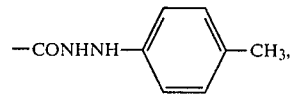
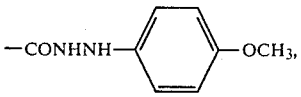
-continued
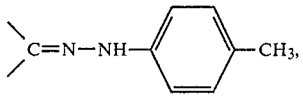
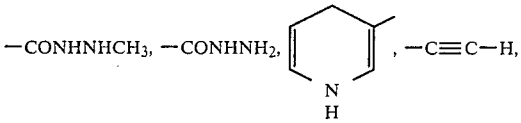
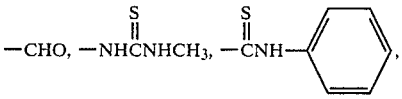
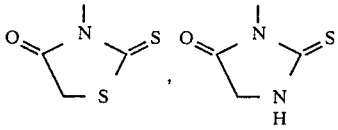
Preferred specific examples of FA in the general formula (II) which can be used are set forth below.
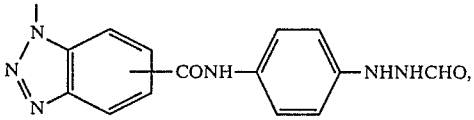
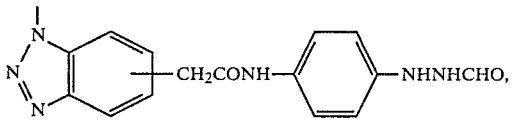
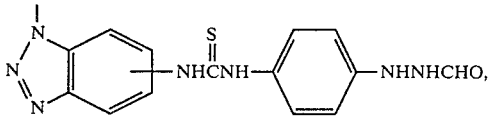
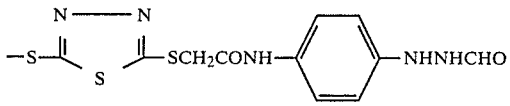
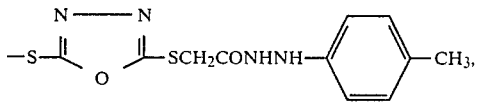
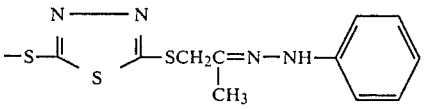
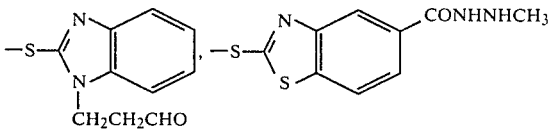

-continued
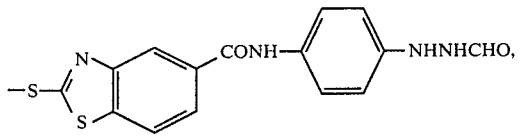
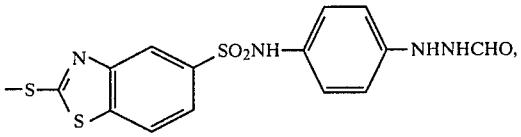
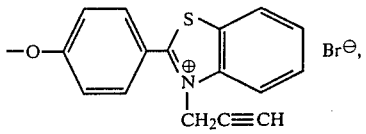
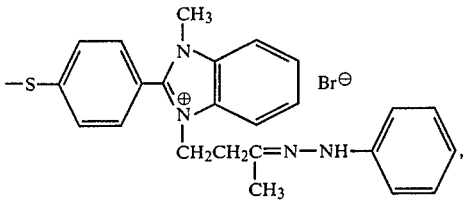
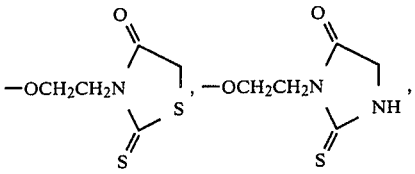
-continued
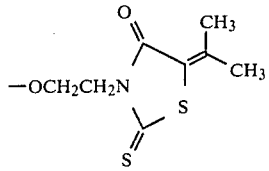
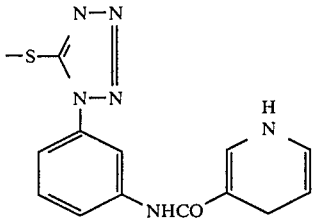
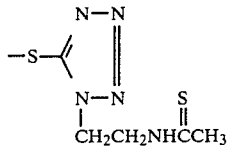
Specific examples of the compounds represented by the general formula (I) which can be used in the present invention are set forth below, but the present invention should not be construed as being limited thereto.
(1)
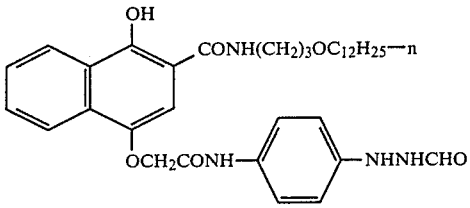
(2)
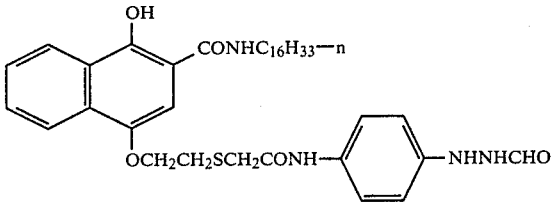
(3)
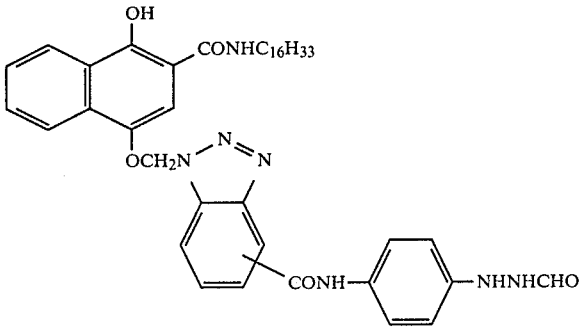

-continued
(4)
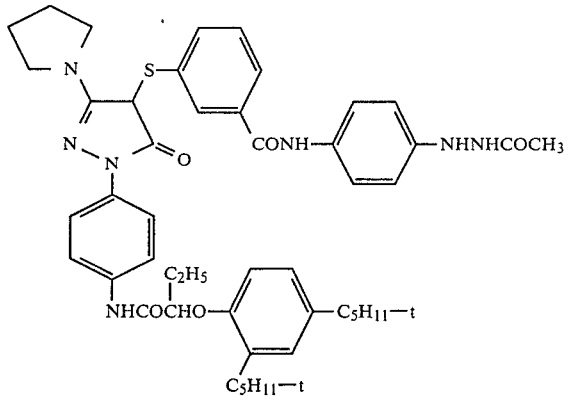
(5)
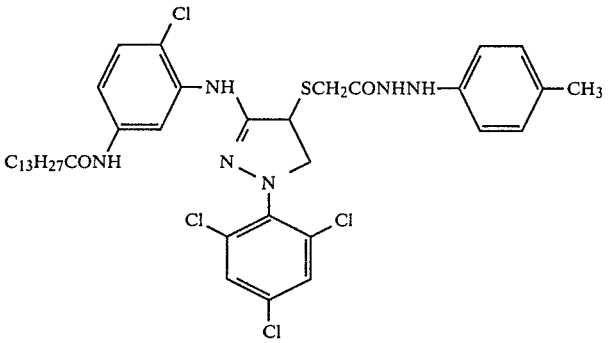
(6)
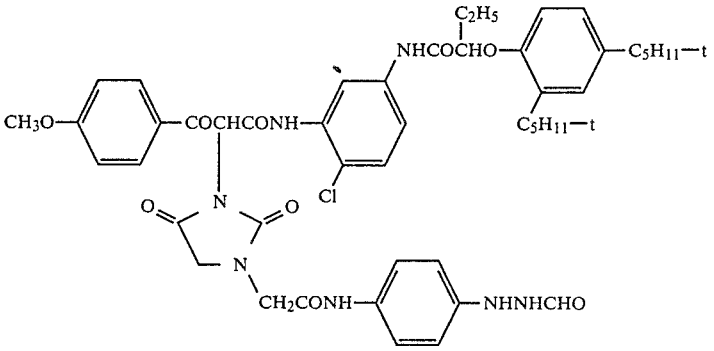
(7)
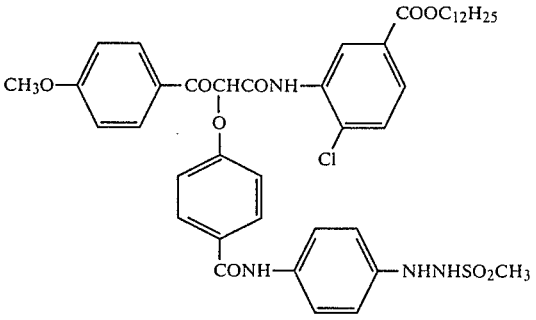

-continued
(8)
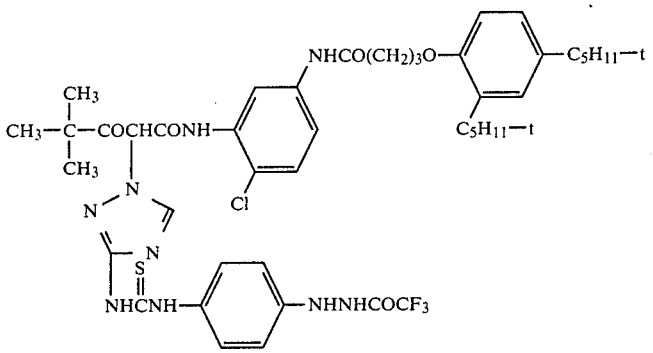
(9)
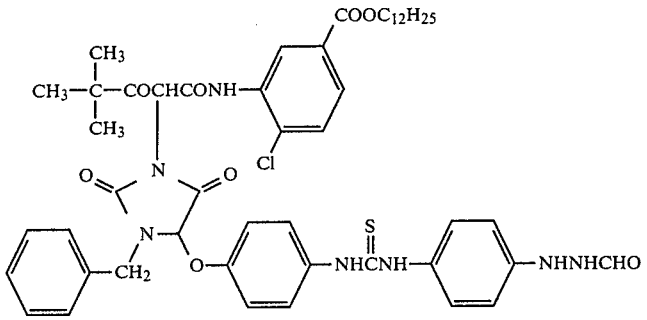
(10)
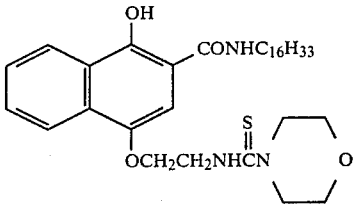
(11)
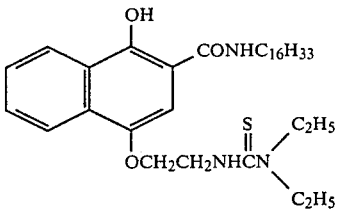
(12)
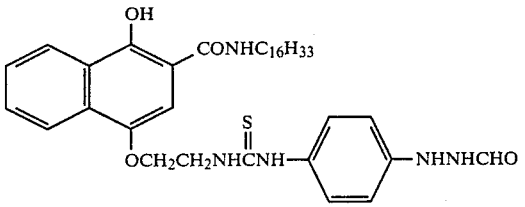
(13)
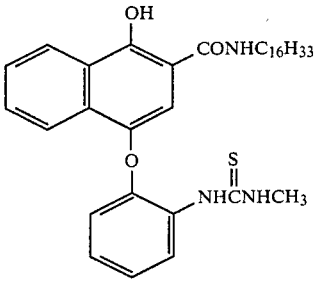

-continued
(14)
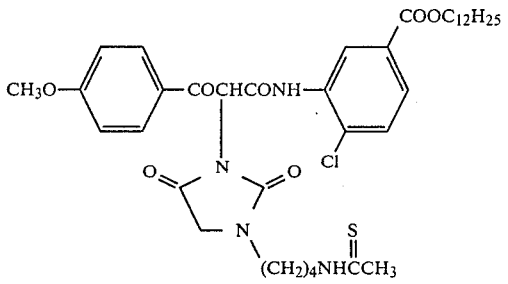
(15)
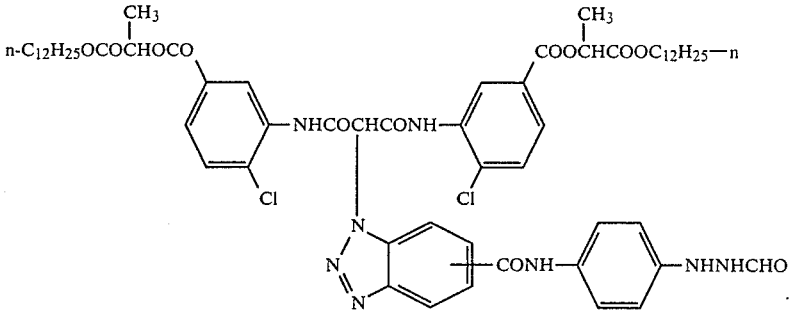
(16)
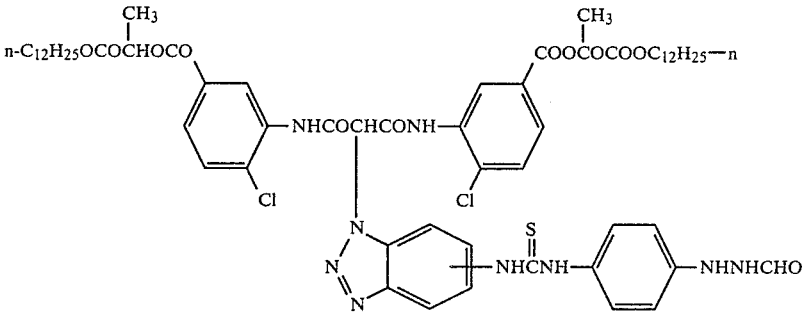
(17)
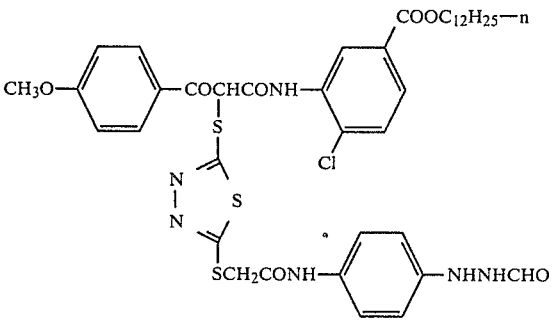
(18)
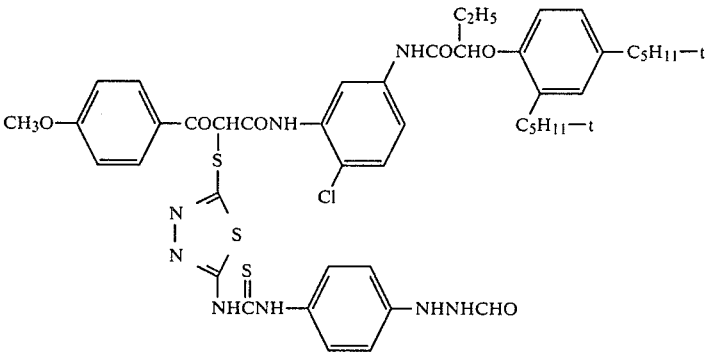

-continued
(19)
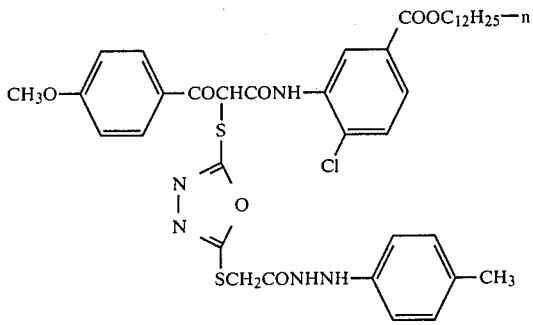
(20)
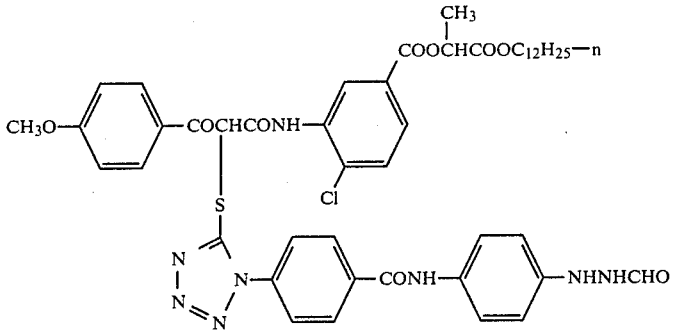
(21)
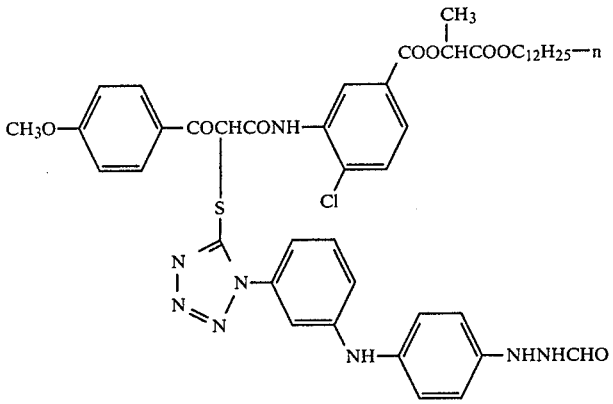
(22)
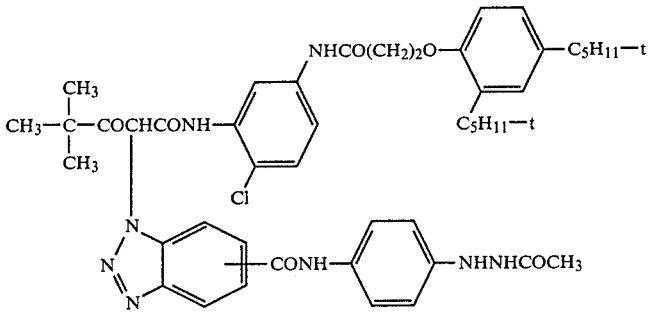
(23)
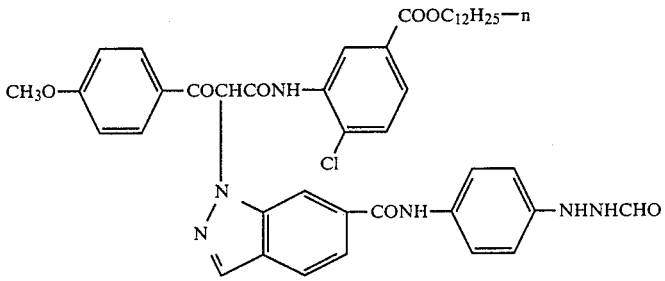

-continued
(24)
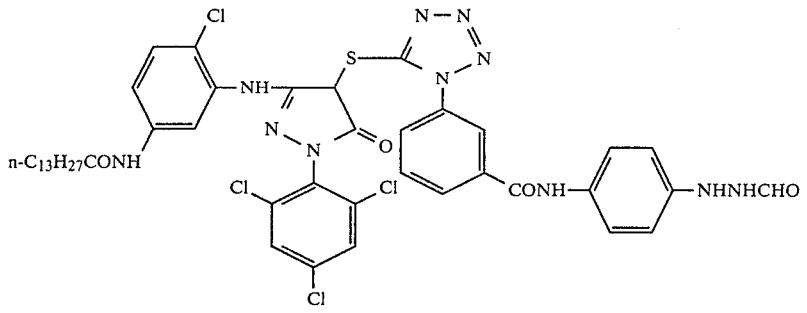
(25)
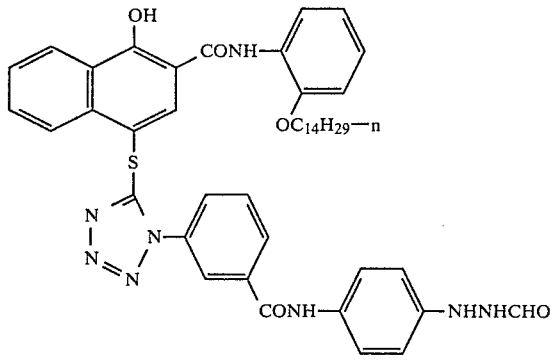
(26)
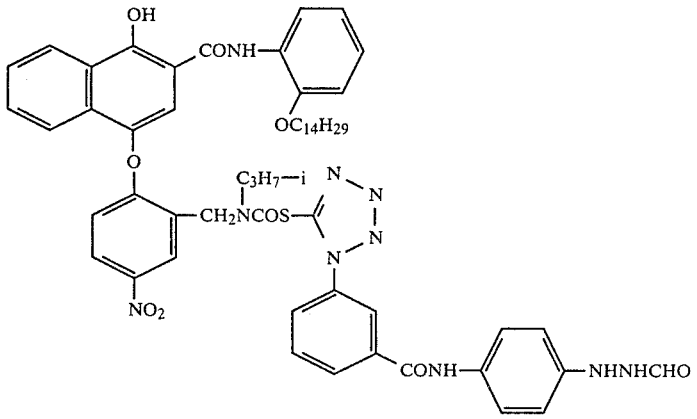
(27)
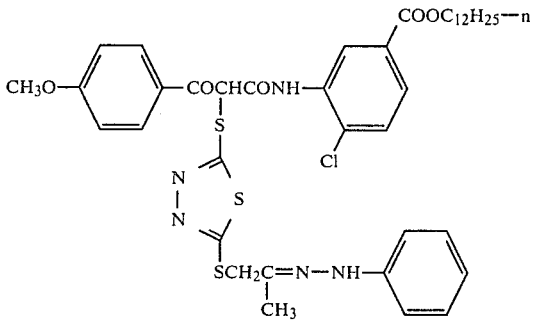

-continued
(28)
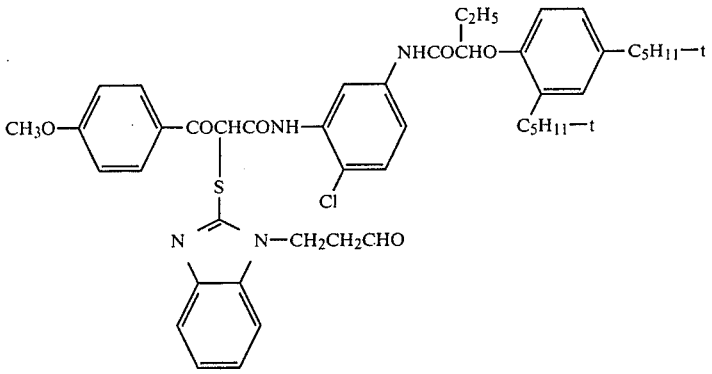
(29)
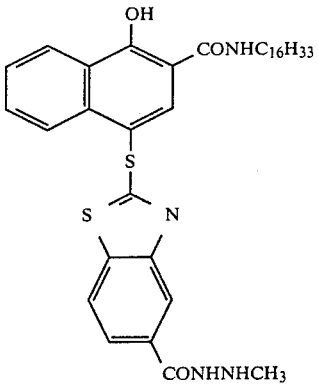
(30)
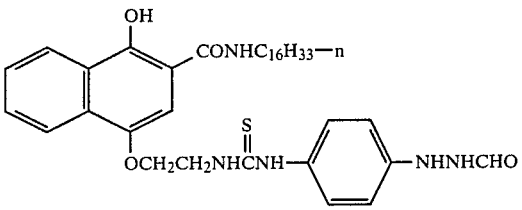
(31)
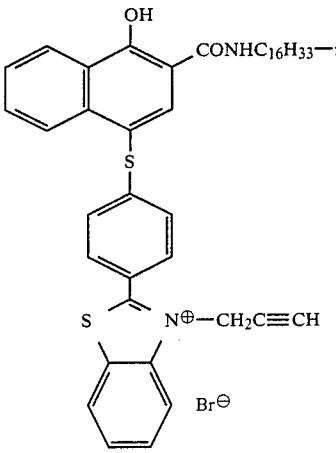

-continued
(32)
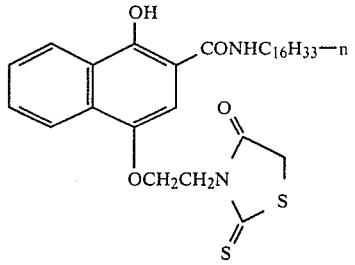
(33)
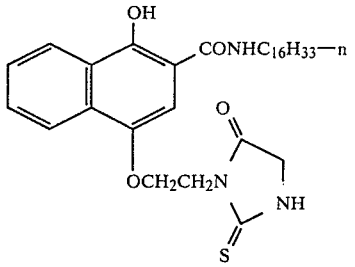
(34)
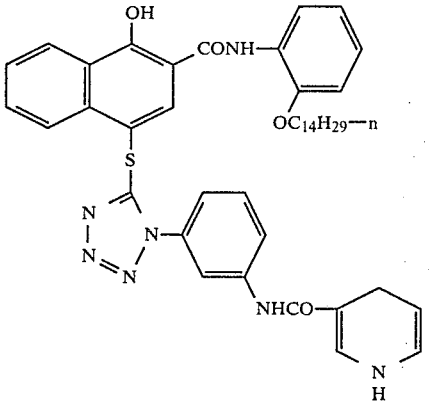
(35)
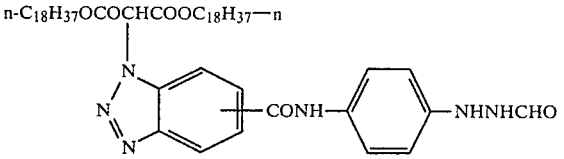
(36)
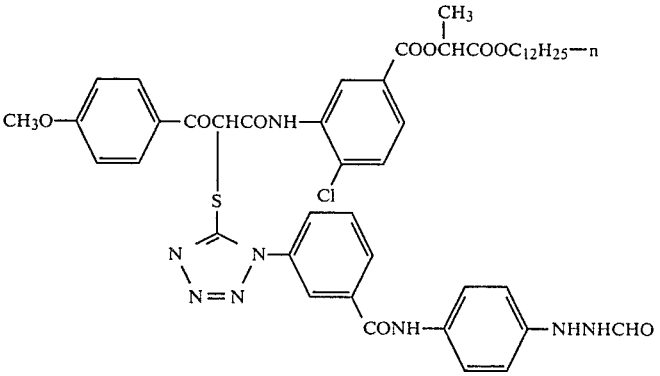

-continued (37)

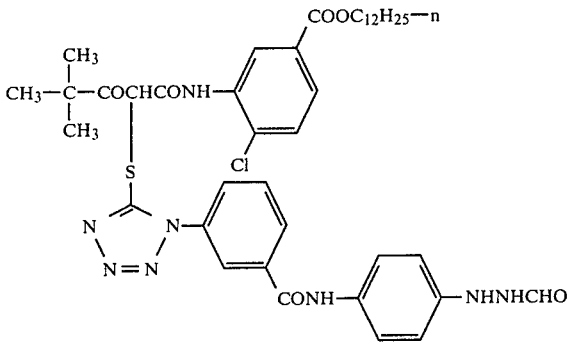

(38)

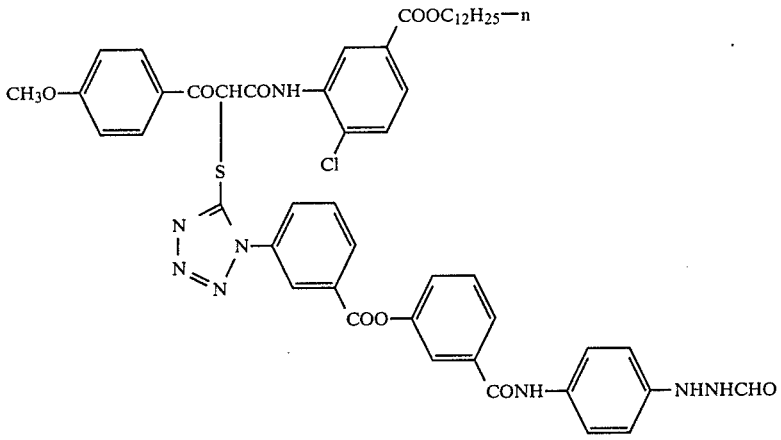

(39)

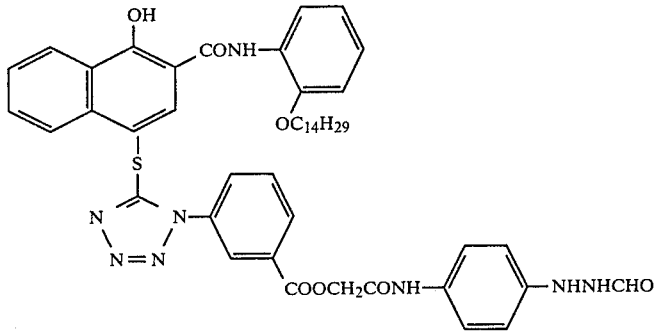

The compound represented by the general formula (I) according to the present invention can be synthesized by the methods as described in Japanese Patent Application (OPI) No. 138636/82, U.S. Pat. No. 4,390,618 and Japanese Patent Application No. 161515/82 (corresponding to U.S. patent application Ser. No. 532,631 filed on Sept. 15, 1983 and West German Patent Application P No. 33 33 355.6 filed on Sept. 15, 1983).

Two or more of the compounds represented by the general formula (I) according to the present invention can be used simultaneously, if desired.

The compound represented by the general formula (I) according to the present invention can be used together with a DIR compound which releases a diffusible releasable group as described in Japanese Patent Application (OPI) No. 151944/82, etc., or a DIR compound having a timing control function as described in Japanese Patent Application (OPI) Nos. 154234/82 and 188035/82, U.S. Pat. No. 4,248,962, etc., and sometimes provides preferred results from the standpoint of granularity, sharpness and color reproducibility.

Also, when the compound represented by the general formula (I) according to the present invention is used together with a coupler which forms a diffusible dye as described in Japanese Patent Application (OPI) No. 82837/82, it is preferred for the granularity to be further improved in some cases.

Furthermore, it is also preferred in view of improving granularity sometimes for the compound represented by the general formula (I) according to the present invention to be used together with a hydroquinone or a compound capable of scavenging the oxidation product of a developing agent as described in U.S. Pat. Nos. 4,252,893 and 3,457,079, etc.

The amount of the compound represented by the general formula (I) according to the present invention which is used is not more than 1 mol, preferably from $10^{-10}$ mol to 0.2 mol, and more preferably from $10^{-7}$ mol to 0.01 mol, per mol of silver in the layer containing the compound. Particularly, the amount of the compound represented by the general formula (II) is not more than 0.1 mol, preferably from $10^{-10}$ mol to 0.05 mol, and more preferably from $10^{-7}$ mol to $10^{-2}$ mol, per mol of silver in the layer containing the compound.

The relatively light-insensitive layer used in the present invention can be a completely light-insensitive layer containing only zinc oxide or titanium oxide or a substantially light-insensitive layer containing silver halide having an extremely low sensitivity.

A preferred particle size for the zinc oxide or titanium oxide used in the relatively light-insensitive layer of the present invention is from about 0.05μ to about 0.8μ and particularly from 0.05μ to 0.5μ.

A relatively light-insensitive silver halide emulsion layer containing silver halide particles having substantially no sensitivity is preferred for the relatively light-insensitive layer of the present invention.

The relatively light-insensitive silver halide emulsion layer preferably used in the present invention is explained in detail below.

The sensitivity of the relatively light-insensitive silver halide emulsion layer of the present invention should be at least 0.5, and is preferably at least 1.0, in log units lower than that of a layer having a lower sensitivity of the adjacent light-sensitive silver halide emulsion layers.

Any of pure silver chloride, pure silver bromide, pure silver iodide, silver chlorobromide, silver iodobromide and silver chloroiodobromide can be present in the relatively light-insensitive silver halide emulsion of the present invention. Silver halides containing 60 mol% or more of silver bromide, 30 mol% or less of silver chloride and 40 mol% or less of silver iodide are preferred. The particle size of the silver halide is not critical, but it is preferably about 0.6 μm or less and more preferably from 0.04 μm to 0.4 μm. More specifically, the particle size is from 0.08 μm to 0.25 μm when the relatively light-insensitive silver halide emulsion layer is positioned between blue-sensitive silver halide emulsion layers, it is from 0.1 μm to 0.3 μm when the relatively light-insensitive silver halide emulsion layer is positioned between green-sensitive silver halide emulsion layers and it is from 0.1 μm to 0.4 μm when the relatively light-insensitive silver halide emulsion layer is positioned between red-sensitive silver halide emulsion layers. Although the relatively light-insensitive silver halide emulsion used in the present invention may have a relatively broad particle size distribution, a narrow particle size distribution is preferred. Particularly, a silver halide emulsion wherein more than 90% of the weight or number of total silver halide particles is within the size range within ±40% of the mean particle size is preferred.

The amount of silver coated for the relatively light-insensitive silver halide emulsion layer is from about 0.03 g/m$^2$ to about 5 g/m$^2$ and preferably is from 0.05 g/m$^2$ to 1 g/m$^2$. Any hydrophilic polymers can be used as a binder in the relatively light-insensitive emulsion layer. Gelatin is particularly preferred. The amount of the binder is preferably not more than 250 g per mol of silver halide.

The relatively light-insensitive silver halide emulsion used in the present invention can be prepared using known methods. That is, the emulsion can be prepared in any suitable manner, for example, by an acid process, a neutral process and an ammonia process, etc. Also, a soluble silver salt and a soluble halide can be reacted in any suitable manner, for example, using a single jet method, a double jet method and a combination thereof, etc. One type of double jet method is a method in which the pAg in the liquid phase where the silver halide is formed is maintained at a constant level (the so-called controlled double jet method). In accordance with this method, a silver halide emulsion having a narrow particle size distribution can be obtained and thus this method is preferred for preparation of the relatively light-insensitive silver halide emulsion as used in the present invention. The relatively light-insensitive silver halide particles may have a regular crystal form such as a cubic, an octahedral, a dodecahedral, a tetradecahedral, etc., form or an irregular crystal form such as that of a sphere, a plate, etc.

The silver halide particles may have a different halide composition between the interior portion and the surface portion thereof or a uniform halide composition. The relatively light-insensitive emulsion may contain cadmium ion, lead ion, iridium ion, rhodium ion, etc., as an impurity. The relatively light-insensitive emulsion may be a surface latent image type emulsion or a internal latent image type emulsion. Also, an emulsion having fogging nuclei in the inner portion of the particles may be used.

The relatively light-insensitive emulsion may be subjected to conventional chemical sensitization, that is, sulfur sensitization, gold sensitization and reduction sensitization. However, chemical sensitization is preferably not used. In the present invention, an emulsion which has not been chemically sensitized (the so-called non-after-ripening emulsion) is preferably used for the relatively light-insensitive emulsion.

The relatively light-insensitive emulsion may contain a cyanine dye, a merocyanine dye, a complex cyanine dye, a complex merocyanine dye, a holopolar cyanine dye, a hemicyanine dye, a styryl dye and a hemioxonol dye, etc. Further, a desensitizing dye, which is not generally used in conventional negative emulsions due to its strong desensitizing effect, can be employed. Moreover, the relatively light-insensitive emulsion may contain an antifogging agent or a stabilizer. For example, an antifogging agent or a stabilizer such as an azole, a heterocyclic mercapto compound, a thioketo compound, an azaindene, a benzenethiosulfonic acid, a benzenesulfinic acid, etc., can be used.

The relatively light-insensitive emulsion layer according to the present invention may contain a dye, or a dispersion of a sparingly soluble synthetic polymer.

The relatively light-insensitive emulsion layer may or may not contain a coupler. A coupler preferably is present in a range of 0.3 mol or less and particularly 0.1 mol or less per mol of silver. Any of the yellow couplers, the magenta couplers, the cyan couplers, the colored couplers and the DIR couplers, etc., as specifically described hereinafter can be used. Also, compounds which provide a colorless compound upon coupling with the oxidation product of a developing agent can be used. Non-color-forming competing compounds are preferred particularly in view of granularity in some cases. Further, use of colored couplers may be preferred from the standpoint of color reproducibility in some cases. Moreover, use of DIR couplers or DIR compounds may be preferred from the standpoint of granularity, sharpness, color reproducibility and/or control of gradation in some cases.

The silver halide photographic light-sensitive material having at least two light-sensitive silver halide emulsion layers which are sensitive to light of substantially the same region of the spectrum in the present invention is a silver halide photographic light-sensitive material having a blue-sensitive layer, a green-sensitive layer and/or a red-sensitive layer wherein any one of these light-sensitive layers or all of these light-sensitive layers are composed of at least two light-sensitive layers. A silver halide photographic light-sensitive material comprising at least two blue-sensitive layers, at least two green-sensitive layers and at least two red-sensitive layers is particularly preferred.

When two or more groupings of light-sensitive layers composed of at least two light-sensitive layers which are sensitive to light of substantially the same region of the spectrum are present in the photographic light-sensitive material of the present invention, the relatively light-insensitive layer may be present between at least one of the groups of light-sensitive layers or the relatively light-insensitive layers may be present between two or more of the groups of light-sensitive layers, respectively.

According to the present invention, the silver halide emulsion layers which are sensitive to light of substantially the same region of the spectrum are present on and under the relatively light-insensitive layer in direct contact therewith.

The couplers according to the present invention can be used for any kind of conventional silver halide color photographic light-sensitive materials, including, for example, color negative films, color papers, color positive films, color reversal films for slide, color reversal films for motion picture use and color reversal films for television use, etc. The couplers are particularly effective for color negative films or color reversal films which must possess both high sensitivities and high image qualities.

With the recent steep rise in the price of silver, which is a raw material for photographic light-sensitive materials, reducing the amount of silver to be used in the photographic light-sensitive materials has become very important, in particular, in the case of X-ray films which require the use of large quantities of silver. From this point of view, use of dyes in X-ray films, for example, through the incorporation of a black color-forming coupler (see, e.g., U.S. Pat. Nos. 3,622,629, 3,734,735 and 4,126,461 and Japanese Patent Application (OPI) Nos. 42725/77, 105247/80 and 105248/80) or of a combination of couplers that form three different colors (see, e.g., *Research Disclosure,* No. 17123) has been proposed. The couplers according to the present invention can be used with particular effectiveness in X-ray films as they contribute to much more effective use of silver and, at the same time, faster processing thereof.

The photographic emulsion layers of the photographic light-sensitive materials of the present invention can contain, in addition to the couplers according to the present invention, conventional color-forming couplers, i.e., compounds capable of forming color upon oxidative coupling with aromatic primary amine developing agents (e.g., phenylenediamine derivatives, aminophenol derivatives, etc.) during the course of color development processing. Examples of such couplers include magenta couplers, such as 5-pyrazolone couplers, pyrazolobenzimidazole couplers, cyanoacetylcoumarone couplers and open chain acylacetonitrile couplers; yellow couplers, such as acylacetamide couplers (e.g., benzoylacetanilides, pivaloylacetanilides, etc.); and cyan couplers, such as naphthol couplers and phenol couplers. Use of couplers containing a hydrophobic group (a so-called ballast group) within the molecule or polymeric non-diffusible couplers is preferred. They may be either 2-equivalent or 4-equivalent couplers with respect to silver. It is also possible to use couplers capable, upon development, of forming a dye having a suitable diffusibility, such as those described in British Patent Application (OPI) No. 2,083,640A. Other examples of usable couplers include colored couplers capable of providing color correction effects, couplers capable of releasing development inhibitors during the course of development (the so-called DIR couplers), as well as non-color-forming DIR coupling compounds capable of releasing development inhibitors and forming colorless coupling products.

In addition to these couplers, the photographic light-sensitive materials of the present invention may contain non-color-forming couplers capable of forming colorless coupling products, infrared couplers capable of forming dyes which absorb infrared rays upon coupling, black color-forming couplers capable of forming black dye images upon coupling, or the like.

Specific examples of magenta color-forming couplers usable in the present invention include those described in U.S. Pat. Nos. 2,600,788, 2,983,608, 3,062,653, 3,127,267, 3,311,476, 3,419,391, 3,519,429, 3,558,319, 3,582,322, 3,615,506, 3,834,908, 3,891,445, 3,926,631, 3,928,044, 4,076,533, 4,189,321 and 4,220,470, West German Patent No. 1,810,464, West German Patent Application (OLS) Nos. 2,408,665, 2,417,945, 2,418,959, 2,424,467, 2,536,191, 2,651,363, 2,935,848 and 2,944,601, Japanese Patent Publication Nos. 6031/65, 38498/79, 10901/80, 29420/80 and 29421/80, and Japanese Patent Application (OPI) Nos. 74027/74, 129538/74, 60233/75, 159336/75, 20826/76, 26541/76, 36938/76, 105820/76, 42121/77, 58922/77, 9122/78, 55122/78, 48540/79, 80744/79, 62454/80 and 118034/80, etc.

Specific examples of yellow color-forming couplers which can be used in the present invention include those described in U.S. Pat. Nos. 2,875,057, 3,265,506, 3,408,194, 3,551,155, 3,582,322, 3,725,072, 3,891,445, 3,894,875, 3,973,968, 3,990,896, 4,008,086, 4,012,259, 4,022,620, 4,029,508, 4,046,575, 4,057,432, 4,059,447, 4,095,983, 4,133,958, 4,157,919, 4,182,630, 4,186,019, 4,203,768 and 4,206,278, West German Patent No. 1,547,868, West German Patent Application (OLS) Nos. 2,213,461, 2,219,917, 2,261,361, 2,263,875, 2,414,006, 2,528,638, 2,935,849 and 2,936,842, British Pat. No. 1,425,020, Japanese Patent Publication Nos. 13576/74, 10783/76, 36856/79 and 13023/80, Japanese Patent Application (OPI) Nos. 26133/72, 66835/73, 6341/75, 34232/75, 87650/75, 130442/75, 75521/76, 102636/76, 145319/76, 21827/76, 82424/77, 115219/77, 48541/79, 121126/79, 2300/80, 36900/80, 38576/80 and 70841/80, and *Research Disclosure,* No. 18053, etc.

Specific examples of cyan color-forming couplers which can be used in the present invention include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,758,308, 3,767,411, 4,004,929, 4,052,212, 4,124,396, 4,146,396 and 4,205,990, West German Patent Application (OLS) Nos. 2,214,489, 2,414,830, 2,454,329, 2,634,694, 2,841,166, 2,934,769, 2,945,813, 2,947,707 and 3,005,355, Japanese Patent Publication Nos. 37822/79 and 37823/79, and Japanese Patent Application (OPI) Nos. 5055/73, 59838/73, 130441/75, 26034/76, 146828/76, 69824/77, 90932/77, 52423/78, 105226/78, 110530/78, 14736/79, 48237/79, 66129/79, 131931/79, 32071/80, 65956/80, 73050/80 and 108662/80, etc.

Specific examples of colored couplers usable in the present invention include those described in U.S. Pat. Nos. 2,521,908, 3,034,892 and 3,476,560, West German Patent Application (OLS) No. 2,418,959, Japanese Patent Publication Nos. 22335/63, 11304/67, 2016/69 and 32461/69, and Japanese Patent Application (OPI) Nos. 26034/76 and 42121/77, etc.

Specific examples of DIR couplers usable in the present invention include those described in U.S. Pat. Nos. 3,227,554, 3,617,291, 3,632,345, 3,701,783, 3,790,384, 3,933,500, 3,938,996, 4,052,213, 4,157,916, 4,171,223, 4,183,752, 4,187,110 and 4,226,934, West German Patent Application (OLS) Nos. 2,414,006, 2,454,301, 2,454,329, 2,540,959, 2,707,489, 2,709,688, 2,730,824, 2,754,281, 2,835,073, 2,853,362, 2,855,697 and 2,902,681, British Pat. No. 953,454, Japanese Patent Publication Nos. 16141/76, 2776/78 and 34933/80, Japanese Patent Application (OPI) Nos. 122335/74, 69624/77, 154631/77, 7232/78, 9116/78, 15136/78, 20324/78, 29717/78, 13533/78, 143223/78, 73033/79, 114241/79, 115229/79, 145135/79, 84935/80 and 135835/80, and *Research Disclosure,* No. 18104, etc. Other examples of usable development inhibitor releasing couplers include those which release development inhibitors by the action of a timing group, as described in British Pat. No. 2,010,818B and British Patent Application (OPI) No. 2,072,363A, etc.

The photographic light-sensitive materials of the present invention can contain compounds capable of releasing development inhibitors during the course of development, other than DIR couplers. Examples of compounds which are usable include those described in U.S. Pat. Nos. 3,297,445 and 3,379,529, West German Patent Application (OLS) No. 2,417,914, and Japanese Patent Application (OPI) Nos. 15271/77 and 9116/78, etc.

Specific examples of non-color-forming couplers which can be used in the present invention include those described in U.S. Pat. Nos. 3,912,513 and 4,204,867, and Japanese Patent Application (OPI) No. 152721/77, etc.

Specific examples of infrared couplers usable in the present invention include those described in U.S. Pat. No. 4,178,183, Japanese Patent Application (OPI) No. 129036/78 and *Research Disclosure,* Nos. 13460 and 18732, etc.

Specific examples of black color-forming couplers usable in the present invention include those described in U.S. Pat. Nos. 4,126,461, 4,137,080 and 4,200,466, and Japanese Patent Application (OPI) Nos. 46029/78, 133432/78, 105247/80 and 105248/80, etc.

The emulsion layers of the photographic light-sensitive materials of the present invention can contain a polymeric coupler, in combination with the coupler according to the invention. Specific examples of usable polymeric couplers include those described in U.S. Pat. Nos. 2,698,797, 2,759,816, 2,852,381, 3,163,652, 3,208,977, 3,211,552, 3,299,013, 3,370,952, 3,424,583, 3,451,820, 3,515,557, 3,767,412, 3,912,513, 3,926,436, 4,080,211, 4,128,427 and 4,215,195 and *Research Disclosure,* Nos. 17825, 18815 and 19033.

The couplers according to the present invention can be incorporated into silver halide emulsion layers using known methods, including those described, e.g., in U.S. Pat. No. 2,322,027. For example, the couplers can be dissolved in a solvent and then dispersed into a hydrophilic colloid. Examples of solvents usable for this process include organic solvents having a high boiling point, such as alkyl esters of phthalic acid (e.g., dibutyl phthalate, dioctyl phthalate, dicyclohexyl phthalate, etc.), phosphates (e.g., diphenyl phosphate, triphenyl phosphate, tricresyl phosphate, dioctyl butyl phosphate, trioctyl phosphate, trihexyl phosphate, tricyclohexyl phosphate, etc.), citrates (e.g., tributyl acetyl citrate, etc.), benzoates (e.g., octyl benzoate, etc.), alkylamides (e.g., diethyl laurylamides, etc.), esters of fatty acids (e.g., dibutoxyethyl succinate, dioctyl azelate, etc.) and trimesates (e.g., tributyl trimesate, etc.); and organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, $\beta$-ethoxyethyl acetate, methyl cellosolve acetate, or the like. Mixtures of the above-described organic solvents having a high boiling point and the above-described organic solvents having a low boiling point can also be used, if desired.

It is also possible to utilize the dispersing method using polymers, as described in Japanese Patent Publication No. 39853/76 and Japanese Patent Application (OPI) No. 59943/76.

Of the compounds according to the present invention, those having an acid group, such as a carboxy group or a sulfo group, can be introduced into hydrophilic colloids as an aqueous alkaline solution.

The photographic emulsion layers and other layers in the photographic light-sensitive materials of the present invention are applied to flexible supports such as synthetic resin films, paper, cloth, etc., or rigid supports such as glass, ceramics, metal, etc., which are conventionally used for photographic light-sensitive materials. Examples of useful flexible supports include films composed of semisynthetic or synthetic high molecular weight materials such as cellulose nitrate, cellulose acetate, cellulose acetate butyrate, polystyrene, polyvinyl chloride, polyethylene terephthalate, polycarbonate, etc., and paper coated or laminated with baryta, α-olefin polymers (for example, polyethylene, polypropylene or ethylene/butene copolymers), etc. The supports may be colored with dyes or pigments. They may have a black color for the purpose of light-shielding. The surface of these supports is generally subjected to a subbing treatment in order to improve the adhesion to the photographic emulsion layer, etc. The surface of the supports may be subjected to corona discharging, ultraviolet light treatment, flame treatment, etc., prior to or after the subbing treatment.

In carrying out the preparation of emulsions, removal of soluble salts from the emulsions after formation of precipitates or physical ripening may be carried out using the noodle washing method in which gelatin is gelled, or a flocculation method utilizing inorganic salts, anionic surface active agents, anionic polymers (for example, polystyrenesulfonic acid), or gelatin derivatives (for example, acylated gelatin, carbamoylated gelatin, etc.).

The silver halide emulsions are usually chemically sensitized. Chemical sensitization processes which can be used are processes as described in H. Frieser, Ed. *Die Grundlagen der Photographischen Prozesse mit Silberhalogeniden* (Akademische Verlagsgesellschaft, 1968), pages 675–734.

Namely, a sulfur sensitization process which comprises using active gelatin and sulfur-containing compounds capable of reaction with silver (for example, thiosulfates, thioureas, mercapto compounds or rhodanines), a reduction sensitization process which comprises using reducing substances (for example, stannous salts, amines, hydrazine derivatives, formamidinesulfinic acid and silane compounds) and a noble metal sensitization process which comprises using noble metal compounds (for example, gold complex salts and complex salts of metals belonging to Group VIII in the Periodic Table, such as Pt, Ir, Pd, etc.), may be used alone or as a combination thereof.

Examples of suitable sulfur sensitization processes are described in U.S. Pat. Nos. 1,574,944, 2,410,689, 2,278,947, 2,728,668 and 3,656,955, of reduction sensitization processes are described in U.S. Pat. Nos. 2,983,609, 2,419,974 and 4,054,458, and of noble metal sensitization processes are described in U.S. Pat. Nos. 2,399,083 and 2,448,060 and British Pat. No. 618,061, etc.

Gelatin is advantageously used, but other hydrophilic colloids can be used, as the binder or the protective colloid for the photographic emulsions of the photographic light-sensitive materials of the present invention.

For example, it is possible to use proteins such as gelatin derivatives, graft polymers of gelatin and other high molecular weight materials, albumin, casein, etc., saccharides such as cellulose derivatives such as hydroxyethyl cellulose, carboxymethyl cellulose, cellulose sulfate, etc., sodium alginate, starch derivatives, etc., and various synthetic hydrophilic high molecular weight substances such as homopolymers or copolymers, for example, polyvinyl alcohol, polyvinyl alcohol semiacetal, poly-N-vinylpyrrolidone, polyacrylic acid, polymethacrylic acid, polyacrylamide, polyvinylimidazole, polyvinylpyrazole, etc.

Not only lime-processed gelatin, but also acid-processed gelatin and enzyme-processed gelatin as described in *Bull. Soc. Sci. Phot. Japan,* No. 16, page 30 (1966) may be used as the gelatin. Further, hydrolyzed products or enzymatic products of gelatin can be used, too.

Further, dispersions of water-insoluble or sparingly soluble synthetic polymers may be present in the photographic emulsion layers and other hydrophilic colloid layers of the photographic light-sensitive materials of the present invention in order to improve dimensional stability. For example, polymers composed of one or more monomers selected from alkyl acrylates, alkyl methacrylates, alkoxyalkyl acrylates, alkoxyalkyl methacrylates, glycidyl acrylates, glycidyl methacrylates, acrylamide, methacrylamide, vinyl esters (for example, vinyl acetate), acrylonitrile, olefins, styrene, etc., and polymers composed of a combination of the abovedescribed monomers and acrylic acid, methacrylic acid, α,β-unsaturated dicarboxylic acid, hydroxyalkyl acrylate, hydroxyalkyl methacrylate, sulfoalkyl acrylate, sulfoalkyl methacrylate, styrenesulfonic acid, etc., can be used.

The hydrophilic colloid layers in the photographic light-sensitive materials of the present invention may be mordanted using cationic polymers where they contain dyes or ultraviolet light absorbing agents. For example, polymers as described in British Pat. No. 685,475, U.S. Pat. Nos. 2,675,316, 2,839,401, 2,882,156, 3,048,487, 3,184,309 and 3,445,231, West German Patent Application (OLS) No. 1,914,362 and Japanese Patent Application (OPI) Nos. 47624/75 and 71332/75, etc., can be used.

The photographic emulsion layers and other hydrophilic colloid layers of the photographic light-sensitive materials of the present invention may contain inorganic or organic hardeners. For example, chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, 1,2-di(vinylsulfonylacetamido)ethane, etc.), active halogen compounds (2,4-dichloro-6-hydroxy-s-triazine, etc.), and mucohalogenic acids (mucochloric acid, mucophenoxychloric acid, etc.), can be used alone or as a combination thereof.

The photographic emulsion layers and other hydrophilic colloid layers in the photographic light-sensitive materials of the present invention may contain surface active agents for various purposes, for example, as coating aids, or for preventing of electrical charging, improvement of slipping properties, emulsification, prevention of adhesion, improvement of photographic properties (for example, acceleration of development, high gradiation or sensitization), etc.

For example, nonionic surface active agents such as saponin (steroid), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyethylene glycol alkylamine or amides, polyethylene oxide adducts of silicone, etc.), glycidol derivatives (for example, alkenylsuccinic acid polyglycerides and alkylphenol polyglycerides), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic sulfonium salts, aliphatic or heterocyclic phosphonium salts, etc., can be used. In addition, fluorine containing surface active agents can be used.

The photographic emulsion layers of the photographic light-sensitive materials of the present invention can contain any of silver bromide, silver iodobromide, silver iodochlorobromide, silver chlorobromide and silver chloride as the silver halide. A preferable silver halide is silver iodobromide.

The photographic emulsions used in the present invention may be spectrally sensitized by methine dyes or others. Although these sensitizing dyes can be used alone, a combination of two or more of them can be used, if desired. A combination of sensitizing dyes is often used for the purpose of supersensitization. The emulsions may contain dyes which do not provide a spectral sensitization function themselves or substances which do not substantially absorb visible light and exhibit supersensitization, together with the sensitizing dyes.

Suitable sensitizing dyes, combinations of dyes which exhibit supersensitization and substances which exhibit supersensitization are described in *Research Disclosure,* Vol. 176, No. 17643, page 23, IV-J (Dec., 1978).

The hydrophilic colloid layers in the photographic light-sensitive materials of the present invention may contain water-soluble dyes as filter dyes or for the purpose of preventing irradiation or for other purposes. Examples of such dyes include oxonol dyes, hemioxonol dyes, styryl dyes, merocyanine dyes, cyanine dyes and azo dyes. Particularly, oxonol dyes, hemioxonol dyes and merocyanine dyes are useful.

For the purpose of increasing sensitivity, increasing contrast or accelerating development, the photographic emulsion layers of the photographic light-sensitive materials of the present invention may contain, for example, polyalkylene oxide or derivatives thereof such as ethers, esters, amines, etc., thioether compounds, thiomorpholines, quaternary ammonium compounds, urethane derivatives, urea derivatives, imidazole derivatives, 3-pyrazolidones, etc. For example, it is possible to use those described in U.S. Pat. Nos. 2,400,532, 2,423,549, 2,716,062, 3,617,280, 3,772,021 and 3,808,003, British Pat. No. 1,488,991, etc.

The photographic emulsions used in the present invention may also contain various compounds for the purpose of preventing fogging or for the purpose of stabilizing the photographic properties during production of the photographic light-sensitive materials, during storage thereof or during photographic processing. For example, various known antifogging agents or stabilizers such as azoles, for example, benzothiazolium salts, nitroindazoles, triazoles, benzotriazoles or benzimidazoles (particularly, nitro- or halogen-substituted benzimidazoles); heterocyclic mercapto compounds, for example, mercaptothiazoles, mercaptobenzothiazoles, mercaptobenzimidazoles, mercaptothiadiazoles, mercaptotetrazoles (particularly, 1-phenyl-5-mercaptotetrazole) or mercaptopyrimidines; the above-described heterocyclic mercapto compounds having water-soluble groups such as a carboxy group, a sulfo group, etc.; thioketo compounds, for example, oxazolinethione; azaindenes, for example, tetraazaindenes (particularly, 4-hydroxy-(1,3,3a,7)-tetraazaindenes); benzenethiosulfonic acids; benzenesulfinic acids; benzenesulfinic acids, etc., can be employed.

The photographic light-sensitive materials of the present invention may contain hydroquinone derivatives, aminophenol derivatives, gallic acid derivatives, ascorbic acid derivatives, etc., as color fog preventing agents.

Known fading preventing agents can be used together in carrying out the present invention. Further, dye image stabilizers when used in the present invention can be used alone or as a mixture of two or more thereof. Examples of known fading preventing agents include hydroquinone derivatives, gallic acid derivatives, p-alkoxyphenols, p-oxyphenol derivatives, bisphenols, etc.

Specific examples of hydroquinone derivatives are described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No.

1,363,921, etc., of gallic acid derivatives are described in U.S. Pat. Nos. 3,457,079 and 3,069,262, etc., of p-alkoxyphenols are described in U.S. Pat. Nos. 2,735,765 and 3,698,909, Japanese Patent Publication Nos. 20977/74 and 6623/77, etc., of p-oxyphenol derivatives are described in U.S. Pat. Nos. 3,432,300, 3,573,050, 3,574,627 and 3,764,337, Japanese Patent Application (OPI) Nos. 33633/77, 147434/77 and 152225/77, etc., and of bisphenols are described in U.S. Pat. No 3,700,455, etc.

The eulsion layers or adjacent layers thereof in the photographic light-sensitive materials of the present invention may contain ultraviolet light absorbing agents as described, for example, in U.S. Pat. Nos. 3,250,617 and 3,253,921, etc., for the purpose of image stabilization.

The present invention can be utilized for photographic light-sensitive materials having a low silver content in which the amount of silver halide in the emulsions is one half to one hundredth that of conventional photographic light-sensitive materials. In such color photographic light-sensitive materials having a low silver halide content, sufficient color images can be obtained by an image formation process wherein the amount of dyes formed is increased by utilizing color intensification, which comprises using peroxides, cabalt complex salts or sodium chloride (for example, West German Patent Application (OLS) No. 2,357,694, U.S. Pat. Nos. 3,674,490 and 3,761,265, West German Patent Application (OLS) Nos. 2,044,833, 2,056,359, 2,056,360 and 2,226,770, Japanese Patent Application (OPI) Nos. 9728/73 and 9729/73, etc.).

Color development of the photographic light-sensitive materials of the present invention can be carried out using known conventional processes. Namely, a negative-positive process which comprises carrying out color development with a substituted p-phenylenediamine to form a dye image and a silver image, processing with a bleaching bath to oxidize the silver image into a silver salt, and removing the residual silver halide and other silver salts by dissolving using a fixing bath to leave the dye image, and a color reversal process which comprises forming a negative silver image by developing with a developing solution containing a black-and-white developing agent, carrying out at least one uniform exposure or suitable fogging treatment, and subsequently carrying out color development, bleaching and fixing to obtain a positive dye image can be used.

Further, in color X-ray films utilizing a developed silver image and a developed dye image, it is possible to use a process comprising color development and fixing which does not comprise bleaching.

The temperature of these color photographic processings is generally in the range of from about 18° C. to about 50° C., but a temperature lower than 18° C. or higher than 50° C. can be used also.

Many known p-phenylenediamine derivatives for developing the photographic light-sensitive materials of the present invention can be used. A particularly suitable p-phenylenediamine type color developing agent includes N,N-dialkyl-p-phenylenediamine compounds the alkyl groups and the phenyl group of which may be or may not be substituted. Examples of particularly suitable compounds include N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-(β-methanesulfonamidoethyl-3-methyl-4-aminoaniline sulfate, N-ethyl-N-β-hydroxyethylaminoaniline, 4-amino-N-(2-methoxyethyl)-N-ethyl-3-methylaniline-p-toluenesulfonate, N,N-diethyl-3-methyl-4-aminoaniline, N-ethyl-N-(β-hydroxyethyl)-3-methyl-4-aminoaniline, etc.

In addition, the compounds as described in L. F. A. Mason, *Photographic Processing Chemistry* (published by Focal Press, 1966), pages 226 to 229, U.S. Pat. Nos. 2,193,015 and 2,592,364, Japanese Patent Application (OPI) No. 64933/73, etc., may be used.

The color developing solution may contain pH buffers, development restrainers, antifogging agents, etc. If desired, the developing solution may contain water softeners, preservatives, organic solvents, development accelerators, dye forming couplers, competing couplers, fogging agents, auxiliary developing agents, thickening agents, polycarboxylic acid chelating agents, antioxidants, etc.

Bleaching processing may be carried out simultaneously with the fixing processing, or these processings may be carried out separately. Suitable bleaching agents which can be used include compounds of polyvalent metal such as iron (III), cobalt (III), chromium (VI), copper (II), etc., peracids, quinones, nitroso compounds, etc. For example, ferricyanides, bichromates, organic complex salts of iron (III) or cobalt (III), complex salts of aminopolycarboxylic acids such as ethylenediaminetetraacetic acid, nitrilotriacetic acid, 1,3-diamino-2-propanoltetraacetic acid, etc., or organic acids such as citric acid, tartaric acid, malic acid, etc.; persulfates, permanganates, nitrosophenol, etc., can be used. Among them, potassium ferricyanide, sodium (ethylenediaminetetraacetato) iron (III) and ammonium (ethylenediaminetetraacetato) iron (III) are particularly preferred. The (ethylenediaminetetraacetato) iron (III) complex salts are useful for both the bleaching solution and the mono-bath bleach-fixing solution.

Various additives including bleaching accelerators as described in U.S. Pat. Nos. 3,042,520 and 3,241,966, Japanese Patent Publication Nos. 8506/70 and 8836/70, etc., thiol compounds as described in Japanese Patent Application (OPI) No. 65732/78, etc., can be present in the bleaching solution or the bleach-fixing solution.

Examples of suitable fixing agents include thiosulfates (for example, ammonium thiosulfate, sodium thiosulfate, potassium thiosulfate, etc.), thiocyanides (for example, ammonium thiocyanid, sodium thiocyanide, potassium thiocyanide, etc.) and thioether compounds such as 3,6-dithia-1,8-octanediol, etc. These compounds may be used alone or as a mixture of two or more thereof.

The present invention is explained in greater detail by reference to the following examples, but the present invention should not be construed as being limited thereto. Unless otherwise indicated, all parts, percents, ratios and the like are by weight.

EXAMPLE 1

On a cellulose triacetate film support were coated layers having the compositions set forth below to prepare a multilayer color photographic light-sensitive material.

First Layer: Antihalation Layer

A gelatin layer containing black colloidal silver

Second Layer: Intermediate Layer

A gelatin layer containing a dispersion of 2,5-di-tert-octylhydroquinone

Third Layer: First Red-Sensitive Emulsion Layer

A silver iodobromide emulsion (iodide content: 5 mol%), silver coated amount: 1.6 g/m$^2$ Sensitizing Dye I—$6\times10^{-5}$ mol per mol of silver
Sensitizing Dye II—$1.5\times10^{-5}$ mol per mol of silver
Coupler EX-1—0.04 mol per mol of silver
Coupler EX-2—0.003 mol per mol of silver
Coupler EX-3—0.0006 mol per mol of silver Fourth Layer: Second Red-Sensitive Emulsion Layer A silver iodobromide emulsion (iodide content: 7 mol%), silver coated amount: 1.4 g/m$^2$ Sensitizing Dye I—$3\times10^{-5}$ mol per mol of silver
Sensitizing Dye II—$1.2\times10^{-5}$ mol per mol of silver
Coupler EX-4—0.02 mol per mol of silver
Coupler EX-2—0.0016 mol per mol of silver Fifth Layer: Intermediate Layer Same as the Second Layer Sixth Layer: First Green-Sensitive Emulsion Layer A silver iodobromide emulsion (iodide content: 4 mol%), silver coated amount: 1.2 g/m$^2$ Sensitizing Dye III—$3\times10^{-5}$ mol per mol of silver
Sensitizing Dye IV—$1\times10^{-5}$ mol per mol of silver
Coupler EX-5—0.05 mol per mol of silver
Coupler EX-6—0.008 mol per mol of silver
Coupler EX-3—0.0015 mol per mol of silver Seventh Layer: Second Green-Sensitive Emulsion Layer A silver iodobromide emulsion (iodide content: 8 mol%), silver coated amount: 1.3 g/m$^2$ Sensitizing Dye III—$2.5\times10^{-5}$ mol per mol of silver
Sensitizing Dye IV—$0.8\times10^{-5}$ mol per mol of silver
Coupler Ex-7—0.017 mol per mol of silver
Coupler EX-6—0.003 mol per mol of silver Eighth Layer: Yellow Filter Layer A gelatin layer containing yellow colloidal silver and a dispersion of 2,5-di-tert-octylhydroquinone Ninth Layer: First Blue-Sensitive Emulsion Layer A silver iodobromide emulsion (iodide content: 6 mol%), silver coated amount: 0.7 g/m$^2$ Coupler EX-8—0.25 mol per mol of silver
Coupler EX-3—0.015 mol per mol of silver Tenth Layer: Second Blue-Sensitive Emulsion Layer A silver iodobromide emulsion (iodide content: 6 mol%), silver coated amount: 0.6 g/m$^2$ Coupler EX-9—0.06 mol per mol of silver Eleventh Layer: First Protective Layer A gelatin layer containing silver iodobromide (iodide content: 1 mol%, average particle size: 0.07$\mu$), silver coated amount: 0.5 g/m$^2$ and a dispersion of Ultraviolet Light Absorbing Agents EX-10 and EX-11

Twelfth Layer: Second Protective Layer

A gelatin layer containing polymethyl methacrylate particles (having a diameter of about 1.5$\mu$) and Formaldehyde Scavenger EX-12

Gelatin Hardener EX-13 and a surface active agent were incorporated into each of the layers in addition to the above-described components.

The sample thus prepared was designated Sample

Light-Insensitive Emulsion Layer

An aqueous silver nitrate solution and an aqueous potassium bromide solution were simultaneously added to an aqueous gelatin solution which had been maintained at a temperature of 50° C. while maintaining the pAg at 7.9 in a reaction vessel to prepare a silver bromide emulsion comprising cubic silver bromide particles having a particle size of 0.14 $\mu$m.

The above-described silver bromide emulsion was coated between the ninth layer and the tenth layer of Sample 101 so that the coated amount of the cubic silver bromide was 0.25 g/m$^2$ or 0.50 g/m$^2$ as shown in Table 1 below to prepare a light-insensitive emulsion layer.

Addition of the Compound According to the Present Invention to the Tenth Layer

The tenth layer was prepared in the same manner as described above for the tenth layer of Sample 101 except that each of Compounds (1), (8), (17), (21) and (32) was added in an amount as set forth in Table 1 below. Thus, Samples 102 to 114 having the compositions shown in Table 1 below were prepared.

Samples 101 to 114 thus-prepared were left for 16 hours under conditions of 40° C. and 70% RH and then exposed to white light through a sensitometric wedge and subjected to the color development processing described below. The densities of the samples thus-processed were measured using a blue filter and the sensitivities of these samples were determined. The sensitivities obtained are shown in Table 1 below as the reciprocal of the exposure amount required for obtaining an optical density of fog+0.2. The sensitivity of Sample 101 was taken as 100 and the other sensitivities are shown relatively.

Further, in order to evaluate the granularity of these samples, they were exposed stepwise, subjected to the color development processing shown below and then the RMS values of these samples were determined using a blue filter at an aperture size of 48$\mu$. The RMS values thus-obtained are multiplied by 1,000 and are shown in Table 1 below.

The color development processing was carried out at 38° C. in the following manner.

1. Color Development—3 minutes and 15 seconds
2. Bleaching—6 minutes and 30 seconds
3. Water Washing—3 minutes and 15 seconds
4. Fixing—6 minutes and 30 seconds
5. Water Washing—3 minutes and 15 seconds
6. Stabilization—3 minutes and 15 seconds The composition of the processing solutions used in each step was as follows.

Color Developing Solution

Sodium Nitrilotriacetate—1.0 g
Sodium Sulfite—4.0 g
Sodium Carbonate—30.0 g
Potassium Bromide—1.4 g
Hydroxylamine Sulfate—2.4 g 4-(N-Ethyl-N-β-hydroxyethylamino)-2-methylaniline Sulfate—4.5 g
Water to make—1 liter Bleaching Solution Ammonium Bromide—160.0 g
Ammonia (28% aq. soln.)—25.0 ml
Sodium (Ethylenediaminetetraacetato) Iron—130.0 g
Glacial Acetic Acid—14.0 ml
Water to make—1 liter Fixing Solution Sodium Tetrapolyphosphate—2.0 g
Sodium Sulfite—4.0 g
Ammonium Thiosulfate (70% aq. soln.)—175.0 ml
Sodium Bisulfite—4.6 g
Water to make—1 liter Stabilizing Solution Formaldehyde—8.0 ml
Water to make—1 liter

*Disclosure,* Vol. 225, No. 22534 (1983), the amounts of Sensitizing Dyes III and IV were increased to 3 times of those in Example 1 and Compound (24) according to the present invention was further added in an amount of $2.0\times10^{-4}$ mol per mol of silver.

Sample 115 was subjected to the same processing and evaluation as described in Example 1. As a result, Sample 115 to which the present invention is applied was confirmed to have increased sensitivity and improved granularity.

EXAMPLE 3

Sample 116 was prepared in the same manner as described for Sample 101 of Example 1 above except that Coupler EX-9 of the eleventh layer was replaced by Coupler EX-14 and Storage Stabilizer EX-15 was further added in an amount of 0.005 mol per mol of silver.

Sample 116 was subjected to the same processing and evaluation as described in Example 1. As a result, Sample 116 to which the present invention is applied was observed to have increased sensitivity and improved granularity.

TABLE 1

| Sample | Light-Insensitive Emulsion Layer ($g/m^2$) | Compound | Amount of* Compound Added | Relative Sensitivity | Granularity |
|---|---|---|---|---|---|
| 101 (Control) | None | — | — | 100 | 33 |
| 102 (Comparison) | 0.25 | — | — | 138 | 31 |
| 103 (Comparison) | 0.50 | — | — | 152 | 31 |
| 104 (Comparison) | None | (21) | $1.2\times10^{-4}$ | 132 | 36 |
| 105 (Present Invention) | 0.25 | (21) | " | 155 | 29 |
| 106 (Present Invention) | 0.50 | (21) | " | 170 | 28 |
| 107 (Comparison) | None | (8) | $0.6\times10^{-4}$ | 129 | 38 |
| 108 (Present Invention) | 0.50 | (8) | " | 167 | 30 |
| 109 (Comparison) | None | (1) | 0.03 | 125 | 37 |
| 110 (Present Invention) | 0.50 | (1) | " | 158 | 30 |
| 111 (Comparison) | None | (32) | $2.4\times10^{-4}$ | 132 | 35 |
| 112 (Present Invention) | 0.50 | (32) | " | 162 | 29 |
| 113 (Comparison) | None | (17) | $4.8\times10^{-4}$ | 129 | 36 |
| 114 (Present Invention) | 0.50 | (17) | " | 155 | 29 |

*mol of the compound added per mol of silver halide in the tenth layer.

From the results shown in Table 1 above it can be seen that Samples 105, 106, 108, 110, 112 and 114 according to the present invention exhibit apparently increased sensitivity in comparison with Comparison Samples 102 and 103 in which the light-insensitive emulsion layer is only employed and apparently are improved in granularity in comparison with Comparison Samples 104, 107, 109, 111 and 113 to which the compound according to the present invention is only added. Further, it is apparent that the samples according to the present invention exhibit both increased sensitivity and improved granularity in comparison with Control Sample 101. Thus, it is clear that the application of the present invention is extremely effective.

EXAMPLE 2

Sample 115 was prepared in the same manner as described for Sample 105 of Example 1 above except that the silver halide emulsion of the seventh layer was replaced by a silver halide emulsion containing tabular grains having an average aspect ratio of 10 or more and an average thickness of 0.21 μm as defined in *Research*

The compounds used for preparing the samples above were as follows:

Sensitizing Dye I

Pyridinium salt of anhydro-5,5'-dichloro-3,3'-di(γ-sulfopropyl)-9-ethylthiacarbocyanine hydroxide Sensitizing Dye II Triethylamine salt of anhydro-9-ethyl-3,3'-di(γ-sulfopropyl)-4,5,4',5'-dibenzothiacarbocyanine hydroxide Sensitizing Dye III Sodium salt of anhydro-9-ethyl-5,5'-dichloro-3,3'-di(γ-sulfopropyl)oxacarbocyanine Sensitizing Dye IV Sodium salt of anhydro-5,6,5',6'-tetrachloro-1,1'-diethyl-3,3'-di{β-[β-(γ-sulfopropoxy)ethoxy]ethyl}-imidazolocarbocyanine hydroxide EX - 1
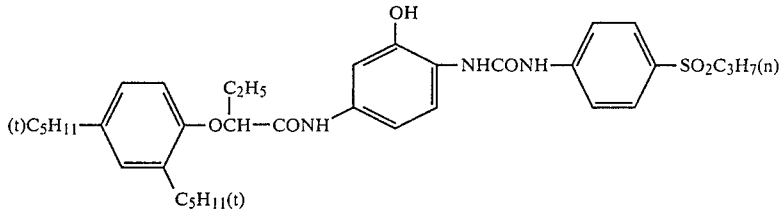
EX - 2
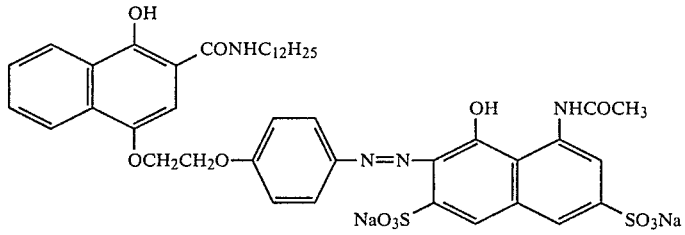
EX - 3
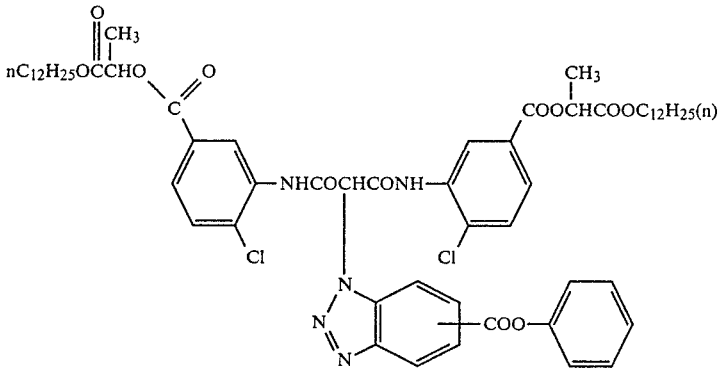
EX - 4
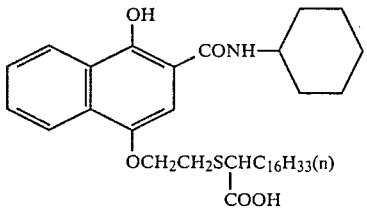
EX - 5
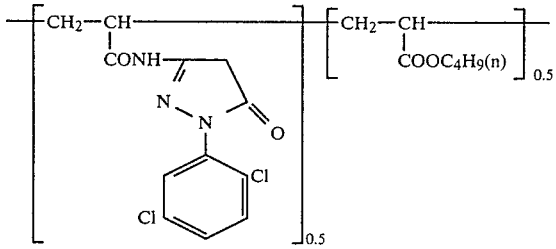
EX - 6
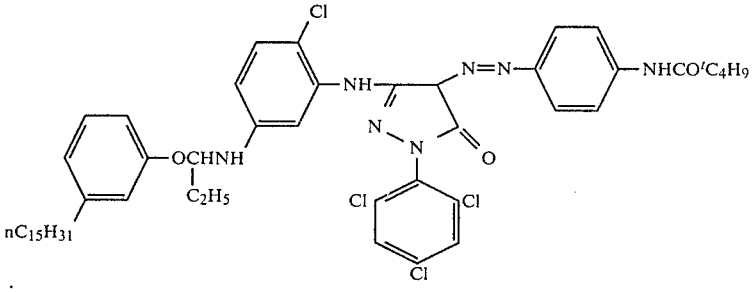

-continued

EX - 7

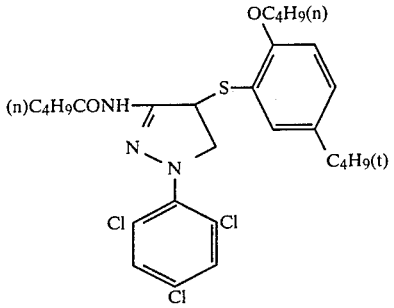

EX - 8

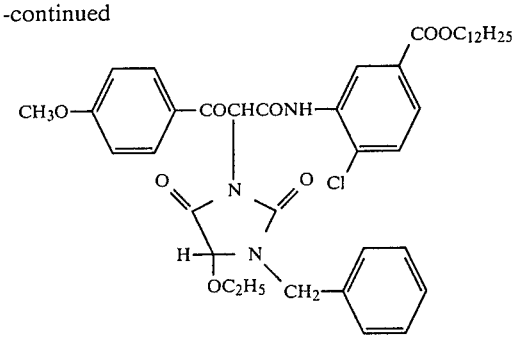

EX - 9

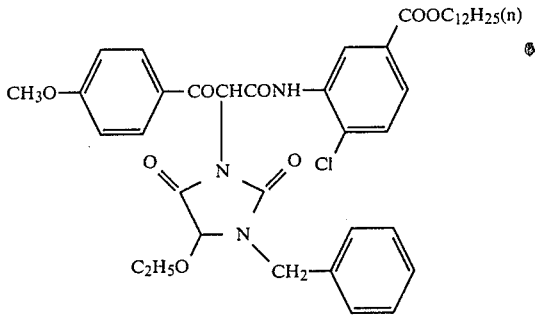

EX - 10

Polymer of

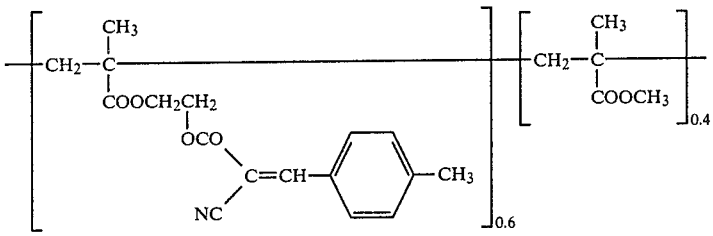

EX - 11

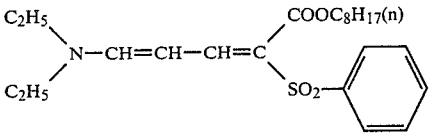

EX - 12

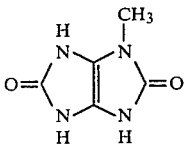

EX - 13

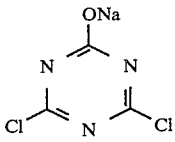

EX - 14

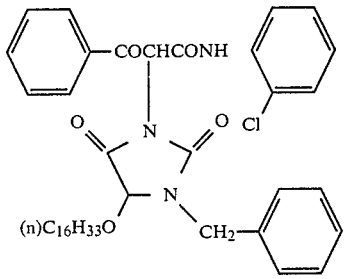

EX - 15

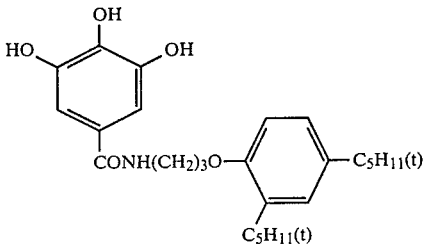

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least two light-sensitive silver halide emulsion layers which are sensitive to light of substantially the same spectral region and a relatively light-insensitive layer containing silver halide, zinc oxide or titanium oxide positioned between the two light-sensitive silver halide emulsion layers and at least one of the two light-sensitive silver halide emulsion layers containing a compound represented by the following general formula (I):

$$A—B \quad (I)$$

wherein A represents a residue of a compound capable of coupling with the oxidation product of an aromatic primary amine developing agent by removal of a hydrogen atom from the active position of the compound, and B represents a group which is released on coupling and exhibits a fogging function in a developing solution.

2. The silver halide photographic light-sensitive material as claimed in claim 1, wherein the residue represented by A is a residue of a cyan coupler, a magenta coupler, a yellow coupler or a non-color-forming coupler formed by the removal of a hydrogen atom from the active position thereof.

3. The silver halide photographic light-sensitive material as claimed in claim 1, wherein the group exhibiting a fogging function represented by B is a group containing a partial structure of a reducing compound or a compound capable of forming silver sulfide.

4. The silver halide photographic light-sensitive material as claimed in claim 1, wherein the compound represented by the general formula (I) is a compound represented by the following general formula (II):

$$A—(TIME)_n—FA \quad (II)$$

wherein A has the same meaning as defined for A in the general formula (I) of claim 1; TIME represents a timing group which is released upon coupling and subsequently FA is released in the developing solution; n represents 0 or 1; and FA represents a group which is capable of being released from A upon coupling when n is 0 or capable of being released from TIME when n is 1 and is capable of being adsorbed on silver halide particles and substantially a fogging function on silver halide.

5. The silver halide photographic light-sensitive material as claimed in claim 4, wherein FA represents a group represented by the following formula:

$$[AD—(L)_m—X—$$

wherein AD represents a group capable of being adsorbed on silver halide particles; L represents a divalent linking group; X represents a reducing group or a group capable of forming silver sulfide at development; and m represents 0 or 1.

6. The silver halide photographic light-sensitive material as claimed in claim 4, wherein FA represents a group capable of being adsorbed on silver halide and capable of being reduced or forming silver sulfide at development.

7. The silver halide photographic light-sensitive material as claimed in claim 4, wherein the residue represented by A is a residue of a cyan coupler selected from the group consisting of a residue of a phenol coupler and a naphthol coupler.

8. The silver halide photographic light-sensitive material as claimed in claim 4, wherein the residue represented by A is a residue of a magenta coupler selected from the group consisting of a residue of a 5-pyrazolone coupler, a pyrazolobenzimidazole coupler, a pyrazolotriazole coupler, a cyanoacetylcoumarone coupler, an open chain acylacetonitrile coupler and an indazolone coupler.

9. The silver halide photographic light-sensitive material as claimed in claim 4, wherein the residue represented by A is a residue of a yellow coupler selected from the group consisting of a residue of a benzoylacetanilide coupler, a pivaloylacetanilide coupler and a malondianilide coupler.

10. The silver halide photographic light-sensitive material as claimed in claim 4, wherein the residue represented by A is a residue of a non-color-forming coupler selected from the group consisting of a residue of an indanone, a cyclopentanone, a diester of malonic acid, an imidazolinone, an oxazolinone and a thiazolinone.

11. The silver halide photographic light-sensitive material as claimed in claim 4, wherein the residue represented by A is a residue represented by the following general formula (III), (IV), (V), (VI), (VII), (VIII), (IX), (X) or (XI):

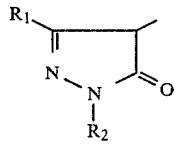

(III)

wherein $R_1$ represents an acylamido group, an anilino group or a ureido group; and $R_2$ represents a phenyl group which may be substituted with one or more substituents selected from the group consisting of a halogen atom, an alkyl group, an alkoxy group and a cyano group;

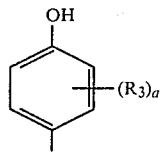

(IV)

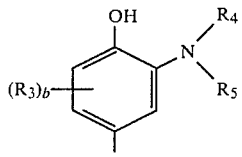

(V)

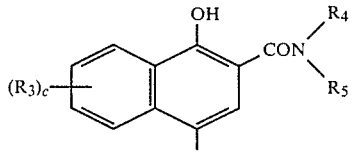

(VI)

wherein $R_3$ represents a halogen atom, an acylamido group or an aliphatic group; $R_4$ and $R_5$ each represents an aliphatic group, an aromatic group or a heterocyclic group, and one of $R_4$ and $R_5$ may represent a hydrogen atom; a represents an integer of 1 to 4; b represents 0 or an integer of 1 to 3; and c represents 0 or an integer of 1 to 5;

(VII)

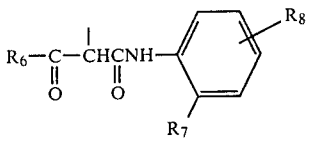

(VIII)

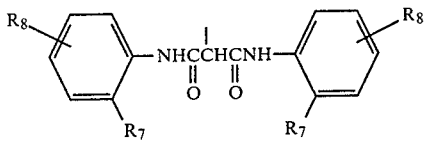

wherein $R_6$ represents a tertiary alkyl group or an aromatic group; $R_7$ represents a hydrogen atom, a halogen atom or an alkoxy group; and $R_8$ represents an acylamido group, an aliphatic group, an alkoxycarbonyl group, a sulfamoyl group, a carbamoyl group, an alkoxy group, a halogen atom or a sulfonamido group;

(IX)

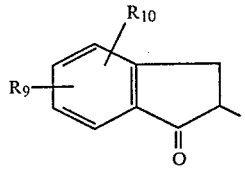

wherein $R_9$ represents an aliphatic group, an alkoxy group, a mercapto group, an alkylthio group, an acylamido group, an alkoxycarbonyl group, a sulfonamido group, a carbamoyl group, a sulfamoyl group, an alkoxysulfonyl group, an aryloxysulfonyl group, an acyl group, a diacylamino group, an alkylsulfonyl group or an arylsulfonyl group; and $R_{10}$ represents a hydrogen atom, a halogen atom, an alkoxy group, an acyl group, a nitro group, an alkylsulfonyl group or an arylsulfonyl group; and the indanone group represented by the general formula (IX) above may be in the form of an enol ester thereof;

(X)

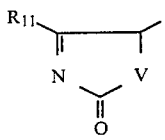

wherein $R_{11}$ represents an aliphatic group or an aromatic group; and V represents an oxygen atom, a sulfur atom or a nitrogen atom;

(XI)

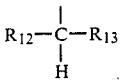

wherein $R_{12}$ and $R_{13}$ each represents a group selected from the group consisting of groups of the formula

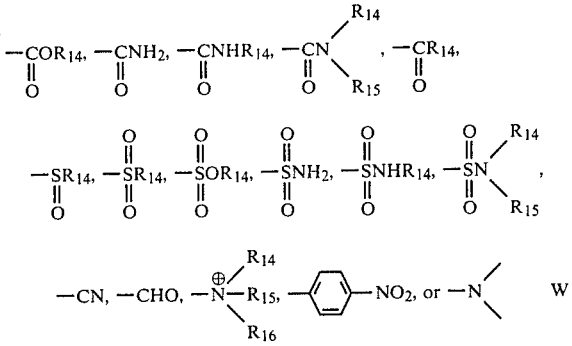

wherein $R_{14}$, $R_{15}$ and $R_{16}$ each represents a hydrogen atom, an aliphatic group, an aromatic group or a heterocyclic group; and W represents the non-metallic atoms necessary to form a 5-membered or 6-membered ring together with the nitrogen atom; or $R_{12}$ and $R_{13}$ in combination may form a 5-membered or 6-membered ring together with the non-metallic atoms necessary.

12. The silver halide photographic light-sensitive material as claimed in claim 4, wherein TIME is a group which is released from A upon coupling and subsequently releases FA due to an intramolecular displacement reaction, a group which releases FA upon electron transfer via a conjugated system or a group of a coupling component capable of releasing FA upon coupling with the oxidation product of an aromatic primary amine developing agent.

13. The silver halide photographic light-sensitive material as claimed in claim 5, wherein the group represented by AD is a group derived from a nitrogen containing heterocyclic ring having a dissociable hydrogen atom, a heterocyclic ring containing at least one nitrogen atom and at least one other hetero atom, a heterocyclic ring having a mercapto group, a quaternary salt, a thiophenol, an alkylthiol or a compound having a partial structure of

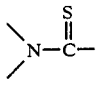

therein.

14. The silver halide photographic light-sensitive material as claimed in claim 5, wherein the divalent linking group represented by L is a member selected from the group consisting of an alkylene group, an alkenylene group, a phenylene group, a naphthylene group, —O—, —S—, —SO—, —$SO_2$—, —N=N—, a carbonyl group, an amido group, a thioamido group, a sulfonamido group, a ureido group, a thioureido group and a heterocyclic group.

15. The silver halide photographic light-sensitive material as claimed in claim 5, wherein the reducing group represented by X is a group derived from a reducing compound selected from the group consisting of a hydrazine, a hydrazide, a hydrazone, a hydroquinone, a catechol, a p-aminophenol, a p-phenylenediamine, a 1-phenyl-3-pyrazolidinone, an enamine, an aldehyde, a polyamine, an acetylene, an aminoborane, a quaternary salt and a carbazinic acid.

16. The silver halide photographic light-sensitive material as claimed in claim 5, wherein the group capable of forming silver sulfide at development represented by X is a group derived from a compound having therein the structure

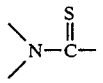

and selected from a thiourea, a thioamide, a dithiocarbamate, a rhodanine, a thiohydantoin and a thiazolidinethione.

17. The silver halide photographic light-sensitive material as claimed in claim 4, wherein FA is bonded to TIME or A at the site of adsorption on silver halide particles thereof.

18. The silver halide photographic light-sensitive material as claimed in claim 4, wherein FA is bonded to TIME or A at a position other than the site of absorption of silver halide particles thereof and the site of adsorption of FA is bonded to a hydrogen atom or blocked with a hydrolyzable group or a releasable group in a developing solution.

19. The silver halide photographic light-sensitive material as claimed in claim 1, wherein the amount of the compound represented by the general formula ()) is from about $10^{-10}$ mol to about 0.2 mol per mol of silver in the silver halide emulsion layer containing said compound represented by the general formula (I).

20. The silver halide photographic light-sensitive material as claimed in claim 1, wherein the relatively light-insensitive layer is a layer containing zinc oxide or titanium oxide.

21. The silver halide photographic light-sensitive material as claimed in claim 20, wherein the particle size of the zinc oxide or titanium oxide is from about 0.05$\mu$ to about 0.8$\mu$.

22. The silver halide photographic light-sensitive material as claimed in claim 1, wherein the relatively light-insensitive layer is a relatively light-insensitive silver halide emulsion layer containing silver halide substantially insensitive to light.

23. The silver halide photographic light-sensitive material as claimed in claim 22, wherein the silver halide of the relatively light-insensitive silver halide emulsion layer comprises 60 mol% or more of silver bromide, 30 mol% or less of silver chloride and 40 mol% or less of silver iodide.

24. The silver halide photographic light-sensitive material as claimed in claim 22, wherein the particle size of the silver halide is about 0.6 $\mu$m or less.

25. The silver halide photographic light-sensitive material as claimed in claim 22, wherein the silver halide emulsion is a silver halide emulsion wherein more than 90%, on a weight or number basis, of all of the silver halide particles is in the size range within $\pm$40% of the mean particle size.

26. The silver halide photographic light-sensitive material as claimed in claim 22, wherein the amount of the silver halide emulsion coated is from 0.03 g/m$^2$ to 5 g/m$^2$ as silver.

27. The silver halide photographic light-sensitive material as claimed in claim 22, wherein the silver halide emulsion is a non-chemically sensitized silver halide emulsion.

28. The silver halide photographic light-sensitive material as claimed in claim 22, wherein the relatively light-insensitive silver halide emulsion layer further contains a coupler.

29. The silver halide photographic light-sensitive material as claimed in claim 1, wherein the photographic material comprises at least two blue-sensitive silver halide emulsion layers, at least two green-sensitive silver halide emulsion layers and at least two red-sensitive silver halide emulsion layers.

30. The silver halide photographic light-sensitive material claimed in claim 1, which exhibits increased sensitivity and gradation and accelerated development capability.

31. The silver halide photographic light-sensitive material as claimed in claim 1, wherein the sensitivity of the relatively light-insensitive silver halide emulsion layer is at least 0.5 in log units lower than that of the layer having the lower sensitivity of the adjacent light-sensitive silver halide emulsion layers.

32. The silver halide photographic light-sensitive material as claimed in claim 1, wherein said sensitivity is at least 1.0 lower.

* * * * *